US006568975B1

(12) United States Patent
Perry et al.

(10) Patent No.: US 6,568,975 B1
(45) Date of Patent: May 27, 2003

(54) STAGED EXPANDABLE SWIM FIN

(76) Inventors: Alan Perry, 2600 Heritage Park Cir., San Jose, CA (US) 95132; Peter H. Müller, 135 Charles St., Los Gatos, CA (US) 95032

( * ) Notice: Subject to any disclaimer, the term of this patent is extended or adjusted under 35 U.S.C. 154(b) by 0 days.

(21) Appl. No.: 10/052,000

(22) Filed: Jan. 16, 2002

(51) Int. Cl.[7] ..... A63B 31/08
(52) U.S. Cl. ..... 441/64
(58) Field of Search ..... 441/61, 62, 63, 441/64

(56) References Cited

U.S. PATENT DOCUMENTS

| | | | | | |
|---|---|---|---|---|---|
| 2,889,563 | A | * | 6/1959 | Lamb et al. | 441/64 |
| 4,787,871 | A | * | 11/1988 | Tomlinson | 441/61 |
| 4,929,206 | A | * | 5/1990 | Evans | 441/64 |
| 4,954,111 | A | * | 9/1990 | Cressi | 441/61 |
| 5,656,323 | A | * | 8/1997 | Underdown | 426/603 |
| 5,813,889 | A | * | 9/1998 | Perry et al. | 441/64 |
| 5,906,525 | A | * | 5/1999 | Melius et al. | 441/64 |
| 6,401,256 | B1 | * | 6/2002 | Shreve | 2/239 |

* cited by examiner

*Primary Examiner*—Stephen Avila
(74) *Attorney, Agent, or Firm*—Glenn Patent Group; Michael A. Glenn; Kirk D. Wong

(57) ABSTRACT

An enhanced swim fin is provided comprising a flipper blade having an increased effective surface area during movement in a first direction, and a decreased effective surface area during movement in a second direction. The swim fin preferably comprises a staged opening during movement in the first direction, in which the opened flipper blade provides increased flexion as the effective surface area is increased. The swim fin preferably comprises a staged closing during movement in the second direction, in which the opened flipper blade provides decreased flexion as the effective surface area is decreased. In some embodiments of the staged swim fin, a central hinge, generally located longitudinally along the blade on the fin, provides staged opening and flexion. Various embodiments provide fin opening and closing for either forward or backward kicks. The enhanced swim fin is typically attached to a foot, such as for performance, for training, or for physical therapy. Alternate embodiments of the expandable fin blade may be attached to a hand or to an oar or paddle shaft.

24 Claims, 21 Drawing Sheets

STAGED EXPANDABLE SWIM FIN

FIELD OF THE INVENTION

The invention relates to the field of athletic equipment. More particularly, the invention relates to a flipper device for aiding a swimmer.

BACKGROUND OF THE INVENTION

Propulsion in swimming typically involves a combination of different forces. Swimmers are propelled primarily by drag forces and assisted by some lift. There is no fixed point in the water from which a swimmer may push. To move the body forward, a swimmer moves water backwards with hands and legs. Lift forces in swimming are primarily caused by the angle of attack of the hands, legs, and feet. The force thus contributed to propulsion is explained by Newton's third law of motion, wherein for each and every action there is an equal and opposite reaction.

The movement of the leg and foot of a swimmer contributes significantly to the propulsion of a swimmer. As the surface of the foot is angled and moved during a kick, the water it encounters is deflected and forced away. Friction causes the leg and foot movements to slow, as the force of the kick is imparted to the water. A force or pressure is thus created that acts upon the surfaces of the leg and foot in an equal and opposite direction. This pressure produces the main force in swimming that propels the body forward.

Certain aquatic mammals, such as the walrus, have finned members to assist in swimming. The hind limbs of the walrus have flexible fins that are radially expandable. The fins are enlarged to provide a greater surface area on the downstroke (or power stroke) kick. The amount of water forced away from the swimming walrus is thereby maximized. The fins are contracted to provide a lesser surface area on the upstroke, minimizing the water resistance encountered. The walrus thus uses the radially expandable fins to optimize its swimming efficiency. Other marine mammals, such as seals, sea lions, and sea otters, use a variety of fore and hind fin movements to provide both propulsion and steering swimming motions.

Foot flipper or fin devices are used by swimmers to assist in their propulsion through water. A flipper is designed to catch water and push it behind to propel the swimmer. FIG. 1 is a top view of a swim flipper 10, according to the prior art. The foot is inserted into the shoe 14 of the flipper. The blade 12 extends from the shoe and provides an enlarged surface area 16 that pushes the water on both the upstroke and the downstroke kick. The enlarged surface area 16 imparts the force of a kick to a larger area of water. The resulting increased equal and opposite pressure acting upon the foot surface propels the swimmer at a faster rate through the water.

It is known to provide rigid members 18 to provide axial support to the blade. Some prior art flipper blades also have channels 17 running along the edges of the blade to facilitate water flow. However, the flippers known in the prior art have a constant width 22, and are not readily expandable to provide an increased surface area during the power kick portion of the periodic fin motion. Such prior art swim flippers maintain a constant surface area on both upstroke and downstroke kicks.

FIG. 2 and FIG. 3 are side views of a prior art swim flipper during an upstroke and a downstroke kick, respectively. An upstroke, as used herein, is a kick towards the surface of the water 24 by a swimmer performing a standard freestyle crawl stroke. As the flipper moves upward, water resistance 26 opposes the flipper's motion, causing the blade to bend downward 28, as seen in FIG. 2. A downstroke is a kick away from the water surface. The water resistance 26 is now directed up towards the flipper, causing the blade to bend upwards 30, as seen in FIG. 3.

The features that have the most influence on the performance of a foot flipper are surface area, flexibility, and weight. Enlarged surface area imparts the force to a larger area of water, but subjects the swimmer to increased water resistance. Flexibility provides increased lift forces through the optimization of the angle of attack of the feet. Additionally, less strength and effort is required to kick with a lighter weight foot flipper.

G. Beuchat, Foot Flipper Device, U.S. Pat. No. 4,300,255 (Nov. 17, 1981), describes a shoe having a fin with a longitudinal cross-section of generally double curvature. The front portion of the shoe forms a separate assembly from the flipper. A rib that may traverse at least a portion of the concave curvature at the tip of the flipper provides axial rigidity. The first curvature is arranged to make the fin adopt a position extending along the axis of the swimmer's leg. The second curve is adapted to make it possible, during the downstroke kick, for the tip of the flipper to conserve an angle of attack which is as close as possible to the axis of the leg, rather than the foot. [(col. 2, lines 32–35)]. During the ascending movement of the leg, the flipper is flattened against the sole of the foot to provide a propulsive force. While Beauchat recognizes that the downstroke kick provides a greater propulsive force than the upstroke, the surface area of the flipper remains constant throughout a swimming motion. Beauchat does not describe an increase of the available surface area during the downstroke kick, nor does it describe a reduction in the surface area of the flipper during the upstroke, such as to minimize the increased water resistance of the upstroke.

L. Cressi, Swimming Flipper Made of Two Different Materials, U.S. Pat. No. 4,954,111 (Sep. 4, 1990), describes a flipper having a blade whose outer sole extends under the heel of the shoe. The blade is equipped with an arched strap which surrounds the shoe transversely, providing a comfortable soft shoe material without compromising the effectiveness of the flipper. The flipper blade is formed of a harder material than the shoe. However, by extending the blade under the heel of the shoe, the deformation caused by the bending of the softer shoe material is minimized. Additionally, the outer portion of the sole is fitted with a transverse strap. The strap holds the foot against the outer sole and blade when the foot is moved upwards. While Cressi describes a fin having enhanced comfort, there is no disclosure of a structure to improve the propulsion generated by the flipper design. Furthermore, there is no disclosure of increasing the available surface area during the downstroke kick to maximize the propulsive force. As well, there is no discussion of reducing the frictional resistance during the upstroke to minimize the effort exerted by the swimmer.

P. Tomlinson, Water Surface Running Fins for the Feet, U.S. Pat. No. 4,787,871 (Nov. 29, 1988), describes a flipper device which enables a user to run on the surface of a body of water. The flipper blade is formed of a plurality of pivotally connected fingers. As the user runs, these fingers pivot to reduce water drag in preparation for the next forward motion stroke.

A. Perry and P. Mueller, Expandable Swim Flipper, U.S. Pat. No. 5,813,889 (Sep. 29, 1998), describe an expandable swim flipper which "includes a blade having at least an expandable portion thereof. The expandable portion radially expands in response to water resistance directed to a first surface of the blade. The surface area of the flipper is correspondingly increased to propel a swimmer at a faster rate through the water. The expandable portion radially contracts in response to water resistance directed to a second surface of the blade. The surface area of the flipper is correspondingly reduced, and is thereby subject to decreased water resistance."

The disclosed prior art fin systems and methodologies thus provide basic swim fins having a variety of designs. However, the prior art fin systems and methodologies fail to provide a fin blade design which offers lateral expansion and contraction, in response to applied water pressure during periodic motion of the fin. Furthermore, the prior art fin systems fail to provide a fin blade design which offers lateral expansion and contraction as well as flexion, in response to applied water pressure during periodic motion of the fin.

It would be advantageous to provide a swim flipper that mimics the hind fins of a walrus to optimize the propulsion of a swimmer through the water. The development of such a swim fin would constitute a major technological advance.

It would also be advantageous to provide a swim fin which laterally expands when moved in a first direction to provide a greater surface area, to maximize the amount of water forced away from the swimmer. The development of such a swim fin would constitute a further technological advance. As well, it would be advantageous to provide a swim fin which laterally contracts when moved in a second direction to provide a lesser surface area, to minimize the water resistance encountered. The development of such a swim fin would constitute a further major technological advance. Furthermore, it would be advantageous to provide a swim fin which provides lateral expansion and contraction, in combination with flexion, in response to applied water pressure during periodic motion of the fin. The development of such a swim fin would constitute a further major technological advance.

SUMMARY OF THE INVENTION

An enhanced swim fin is provided comprising a flipper blade having an increased effective surface area during movement in a first direction, and a decreased effective surface area during movement in a second direction. The swim fin preferably comprises a staged opening during movement in the first direction, in which the opened flipper blade provides increased flexion as the effective surface area is increased. The swim fin similarly preferably comprises a staged closing during movement in the second direction, in which the opened flipper blade provides decreased flexion as the effective surface area is decreased. In some embodiments of the staged swim fin, a central hinge, generally located longitudinally along the blade on the fin, provides staged opening and/or flexion. Various embodiments provide fin opening and closing for either forward or backward kicks. The enhanced swim fin is typically attached to a foot, such as for performance, for training, or for physical therapy. Alternate embodiments of the expandable fin blade may be attached to a hand or to an oar or paddle.

DETAILED DESCRIPTION OF PREFERRED EMBODIMENTS

Figure 1:
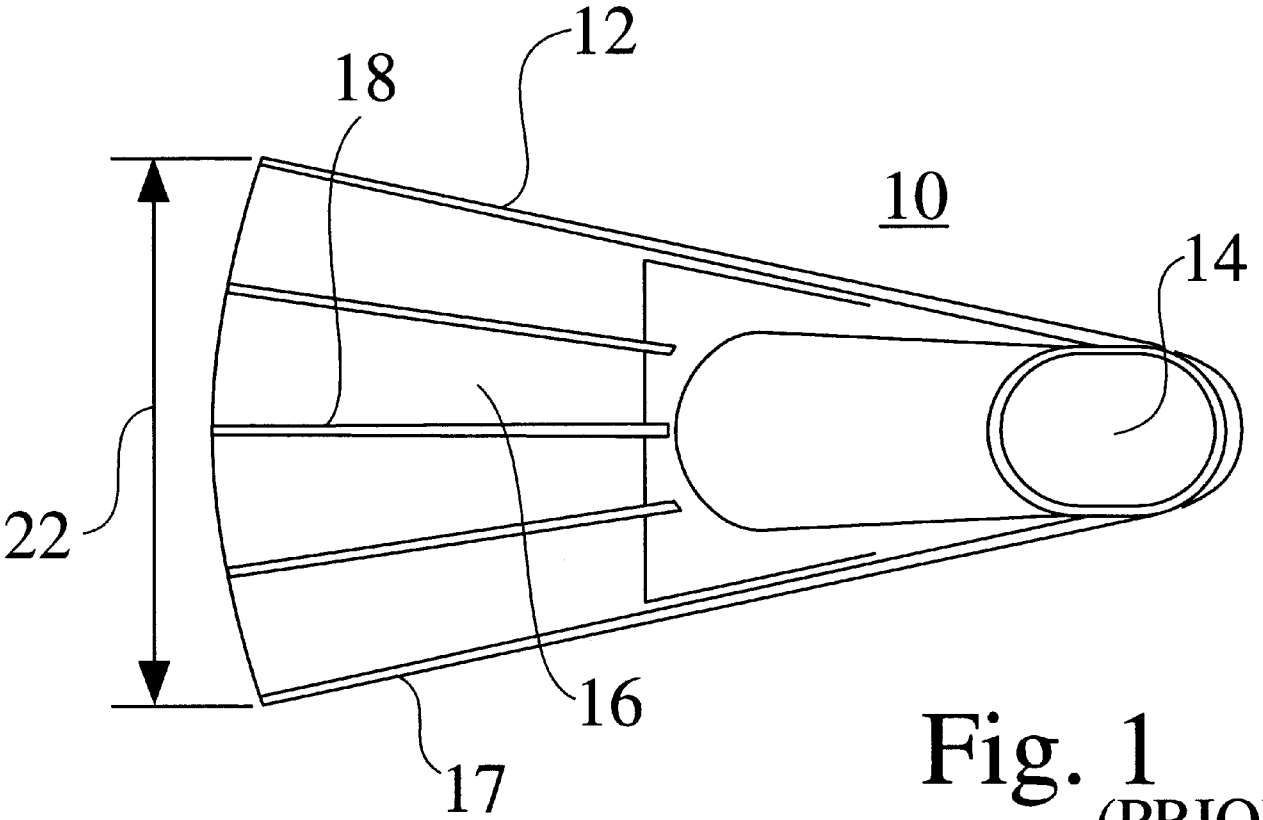
Fig. 1 (PRIOR ART)
FIG. 1 is a top view of a conventional swim flipper having guides and vents.
Figure 2:
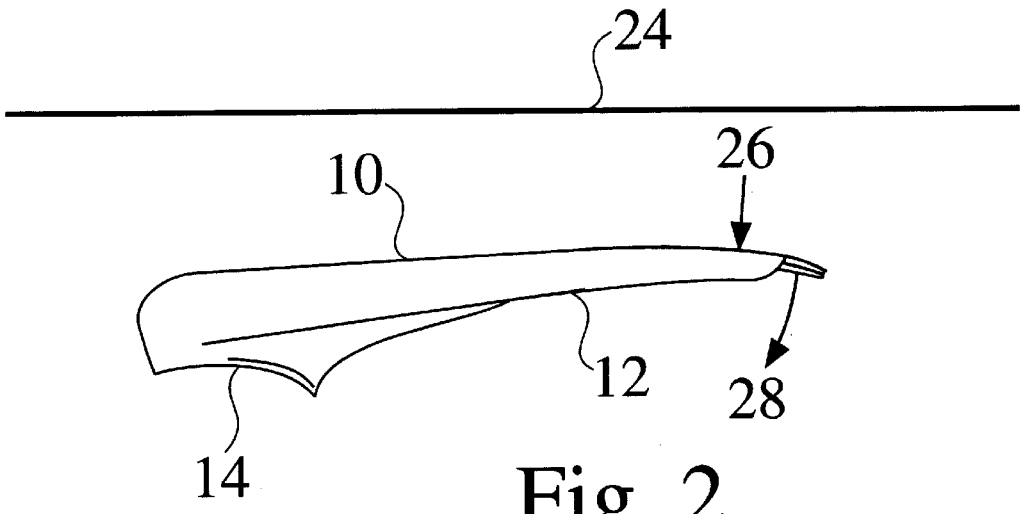
Fig. 2 (PRIOR ART)
FIG. 2 is a side view of a conventional swim flipper during an upstroke.
Figure 3:
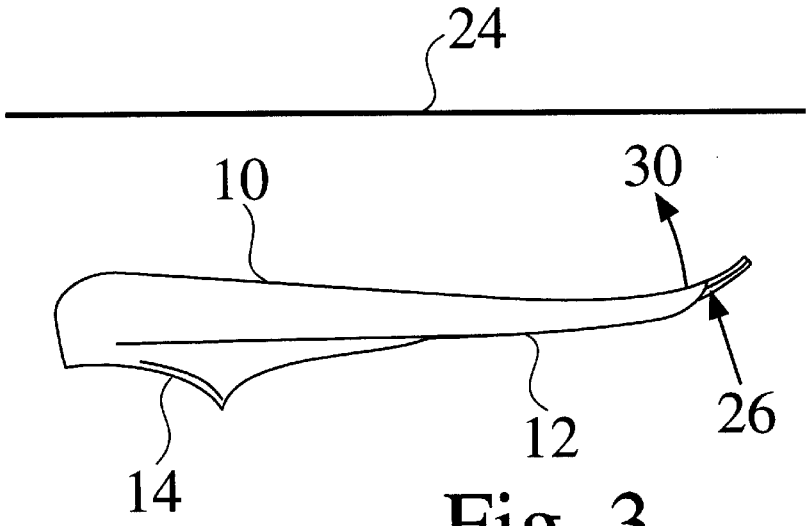
Fig. 3 (PRIOR ART)
FIG. 3 is a side view of a conventional swim flipper during a down stroke.
Figure 4:
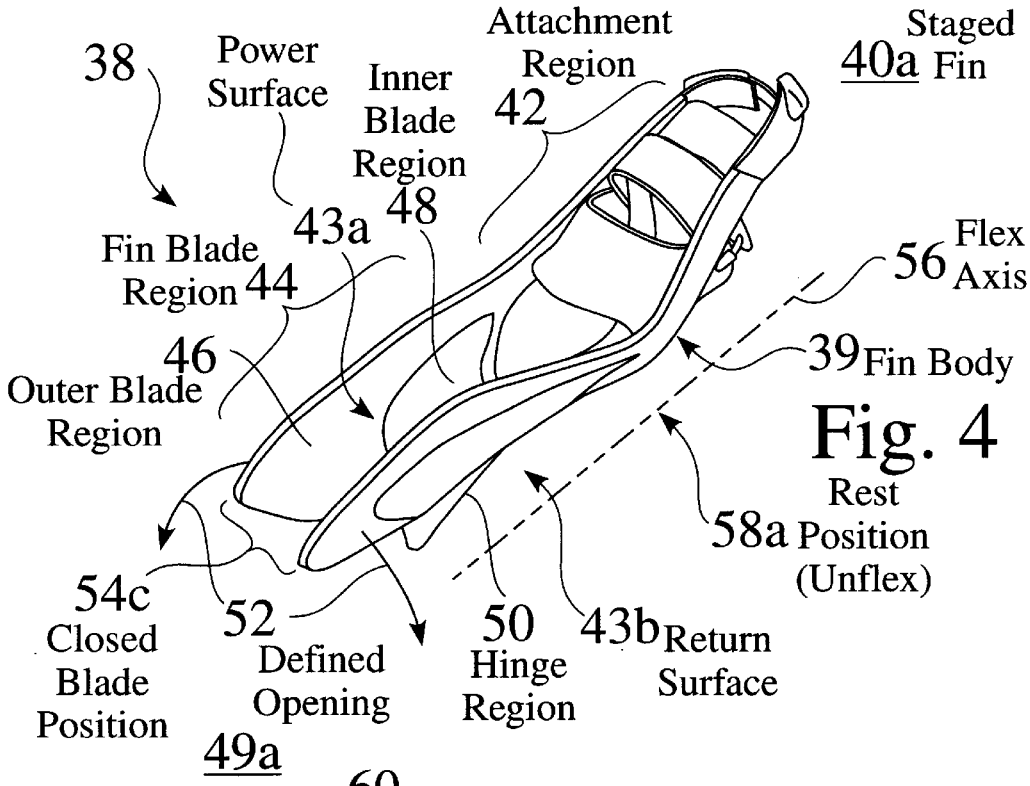
FIG. 4 is a perspective view of a staged fin in a closed position.

FIG. 4 is a perspective view 38 of an enhanced staged swim fin 40*a* in resting position 49*a*, comprising a closed blade position 54*c* and a resting flexion position 58*a*. FIG.

5 is a perspective view 60 of an enhanced staged fin 40*a* in an expanded position 40*b*, in which the expandable fin blade is fully open 54*o* and fully flexed 58*k*. The staged swim fin 40*a* typically comprises an attachment region 42 and a fin blade region 44.

Figure 5:
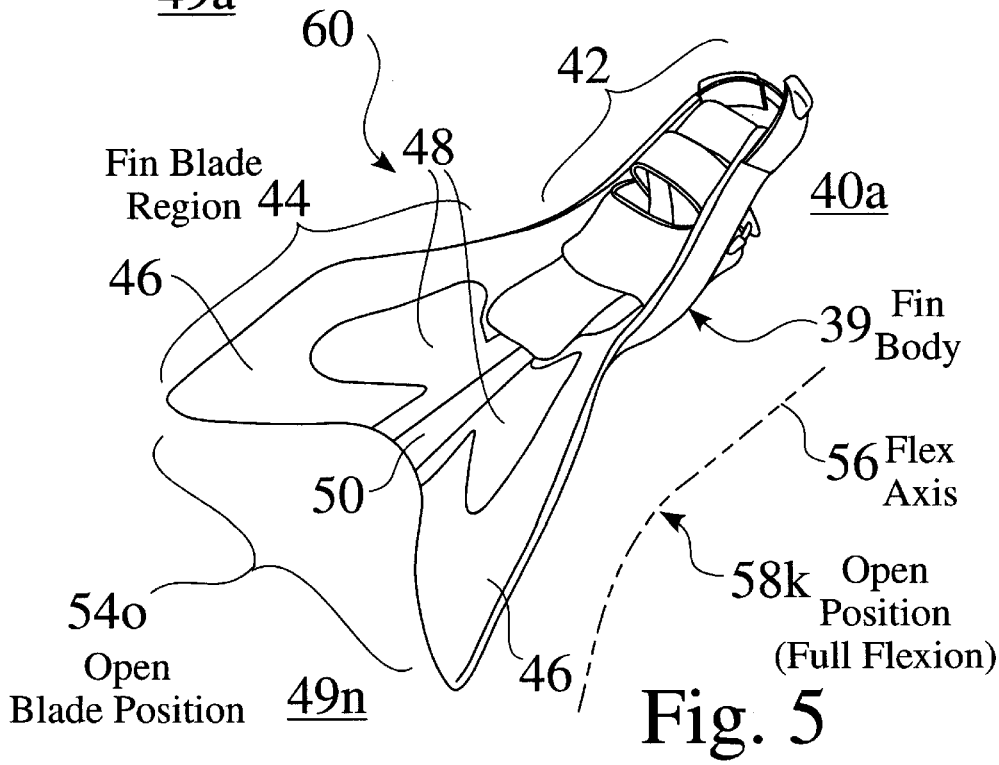
FIG. 5 is a perspective view of a staged fin in an expanded position, in which the expandable fin blade is fully open and fully flexed.
Figure 15:
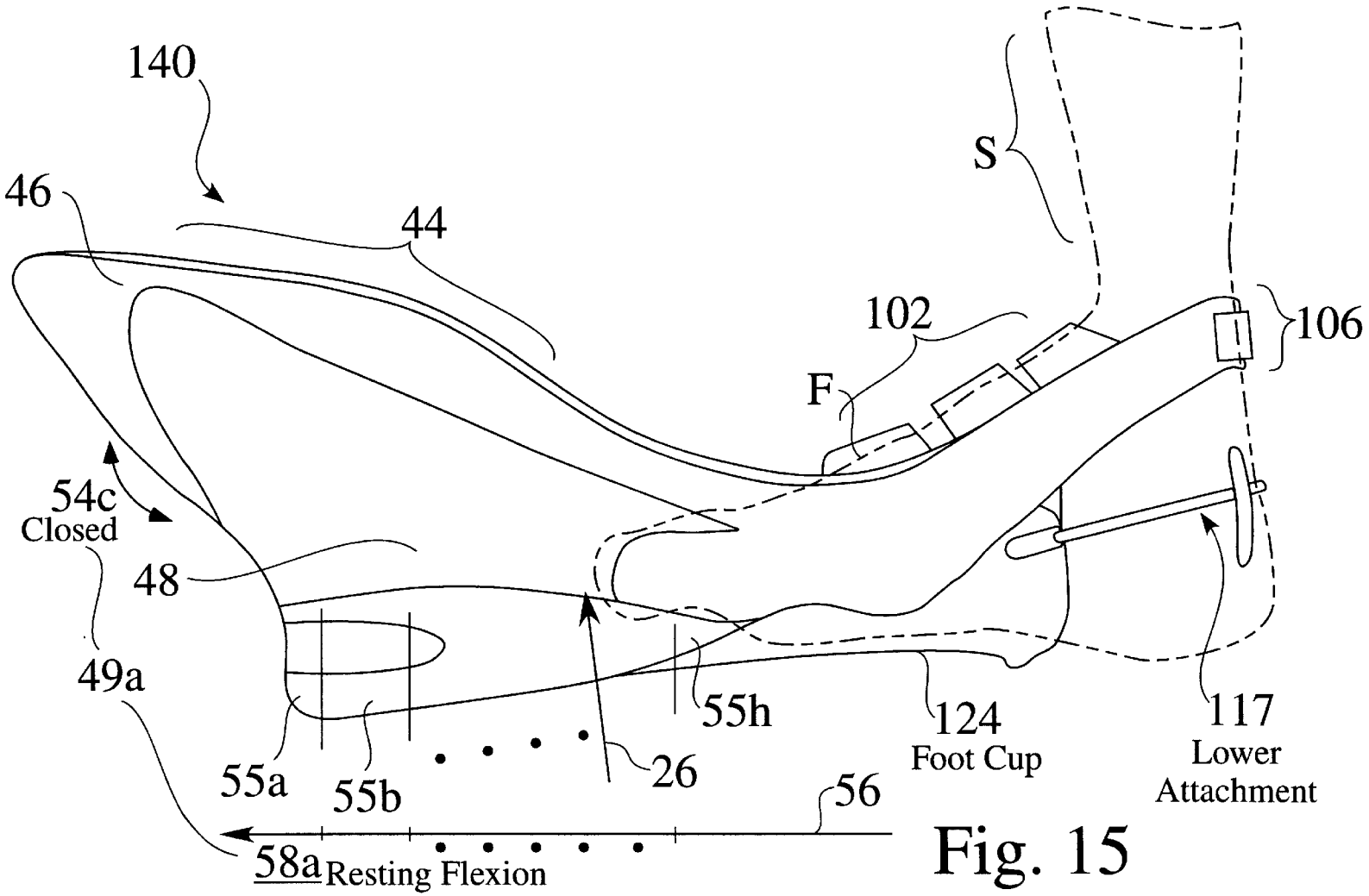
FIG. 15 is a side view of a staged swim fin in a resting unexpanded position.
Figure 16:
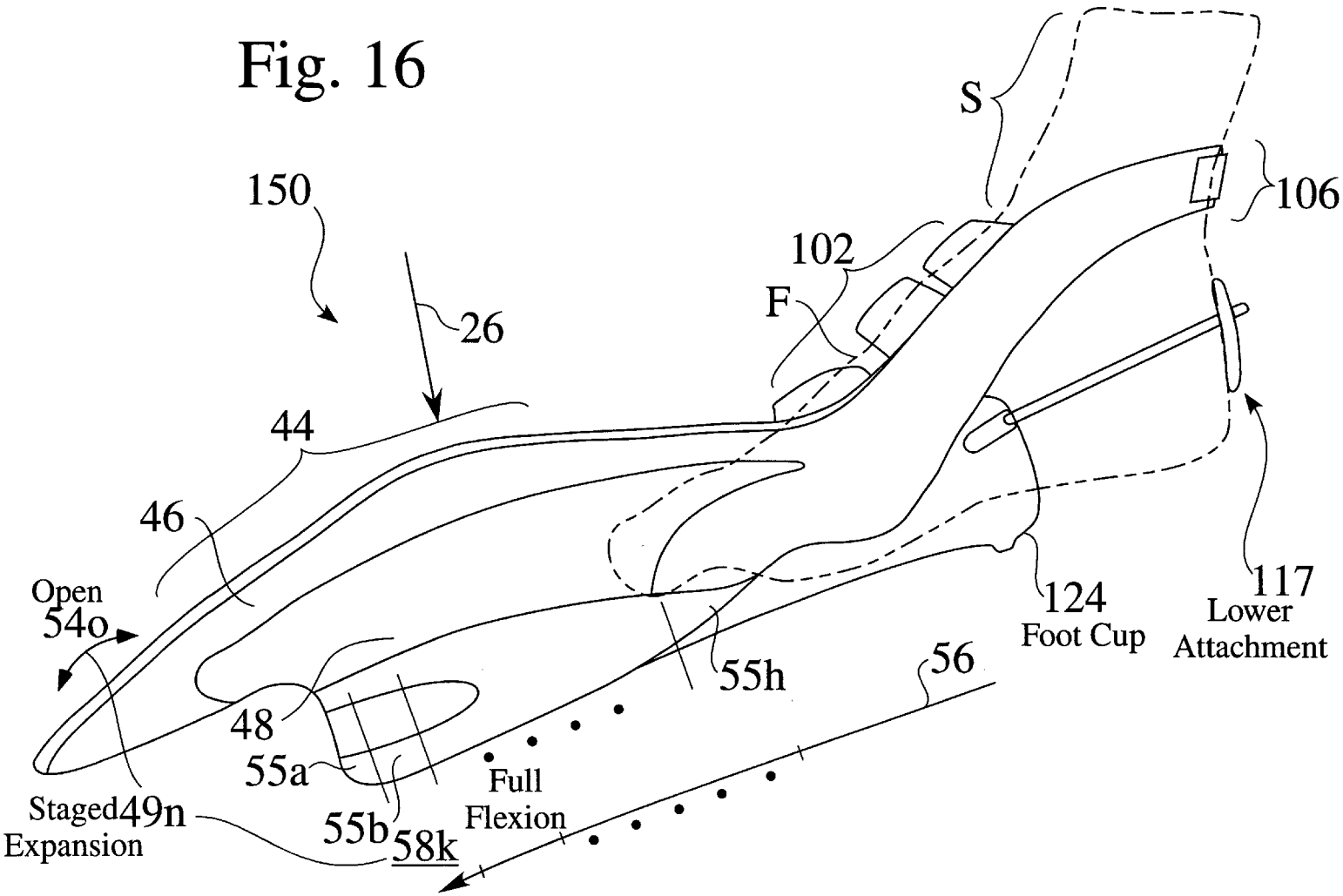
FIG. 16 is a side view of a staged swim fin in an expanded position.
Figure 17:
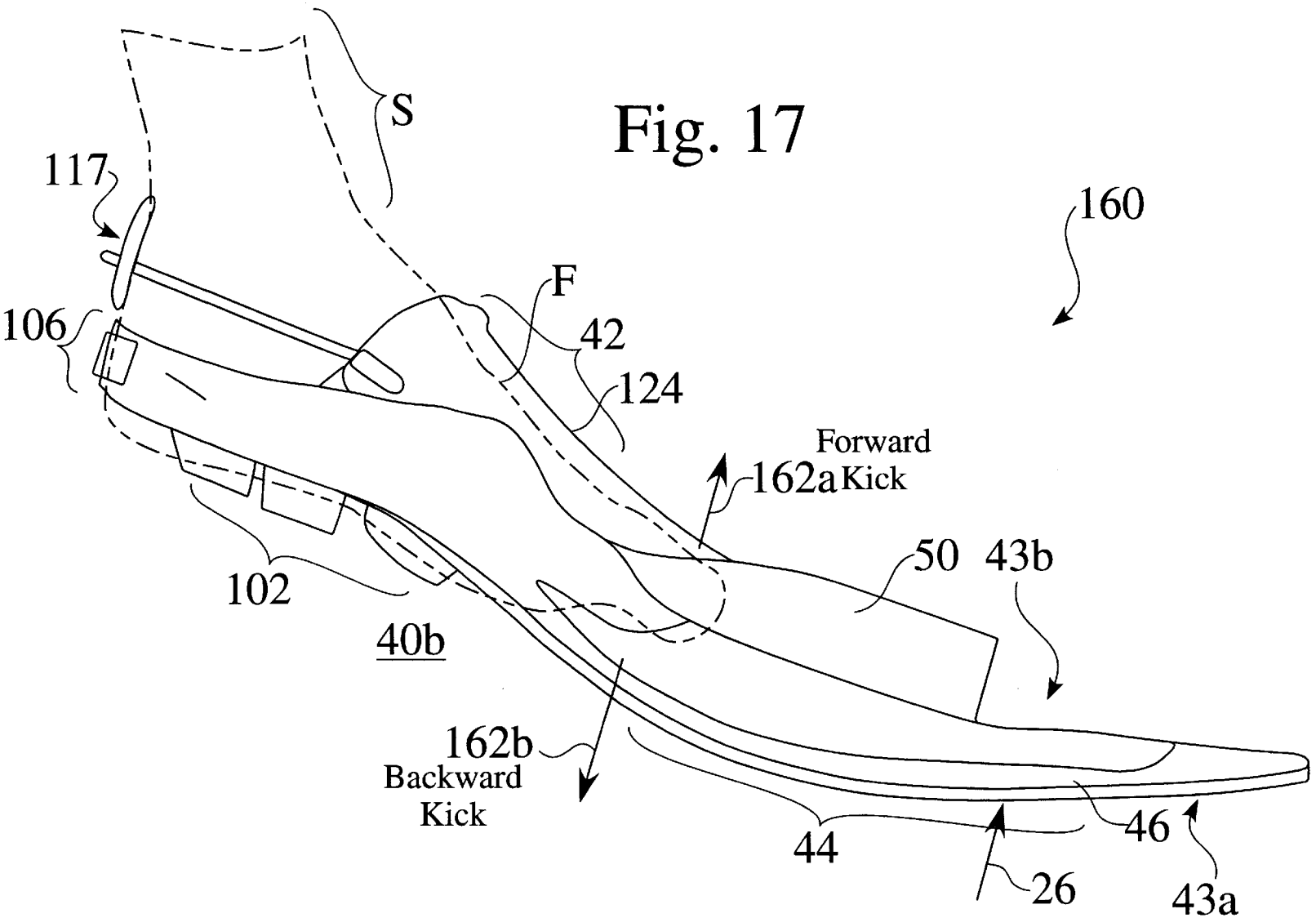
FIG. 17 is a side view of an alternate staged swim fin in an expanded position.
Figure 22:
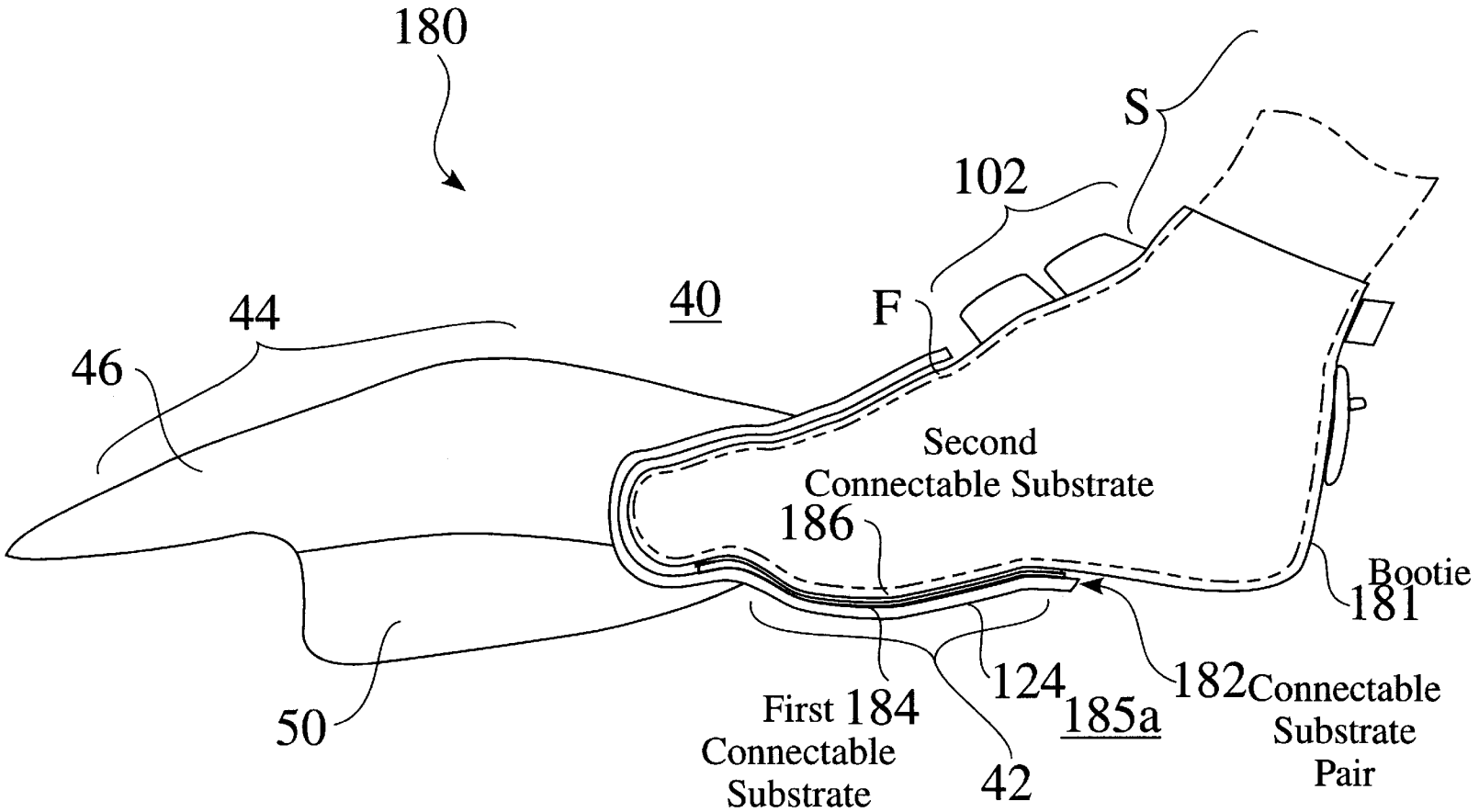
FIG. 22 is a side view of connectable substrate boot attachment.
Figure 23:
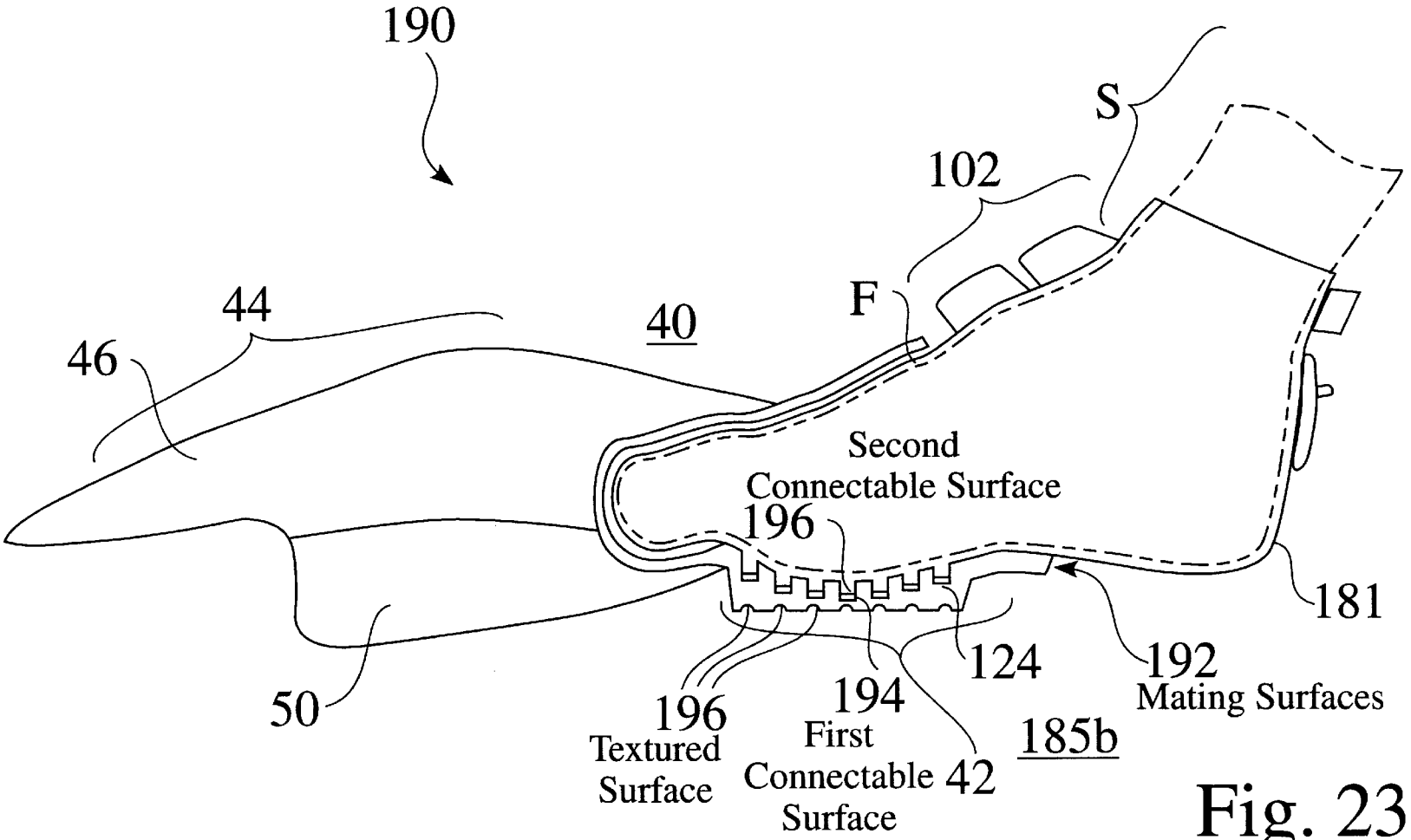
FIG. 23 is a side view of connectable surface boot attachment.
Figure 24:
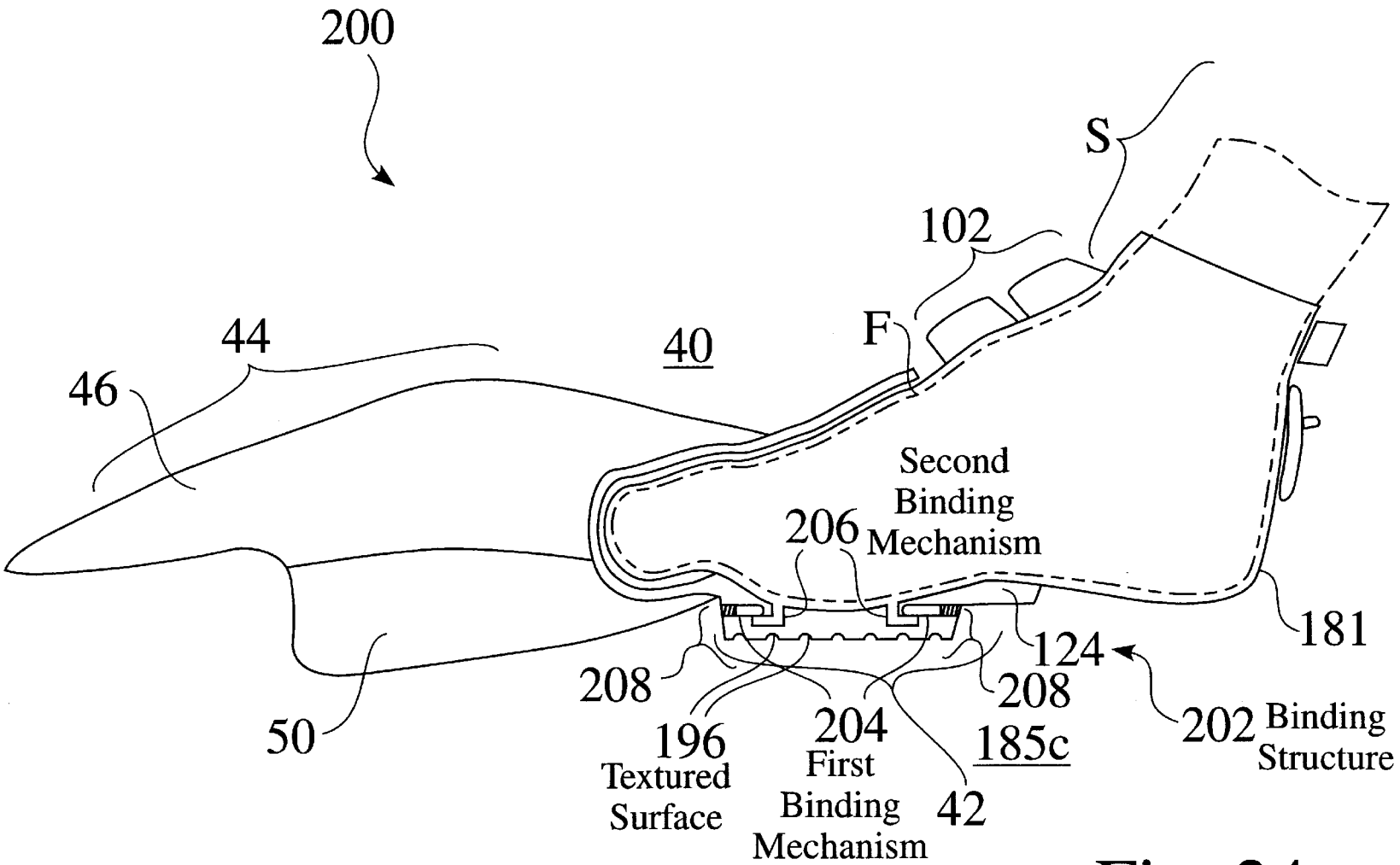
FIG. 24 is a side view of binding structure secure boot attachment.

The expandable swim fin 40*a* shown in FIG. 4 and FIG. 5 is attachable to a foot F (FIG. 15–FIG. 17; FIG. 22–FIG. 24) of a swimmer S (FIG. 15–FIG. 17; FIG. 22 FIG. 24), and is commonly used as one of a pair of staged fins 40*a*. As well, a swimmer S may additionally use a water sock or bootie 181 (FIG. 22–FIG. 24), as an intermediate layer between a foot F and the staged swim fin 40, such as for fit, protection, comfort, and/or for thermal insulation.

Figure 8:
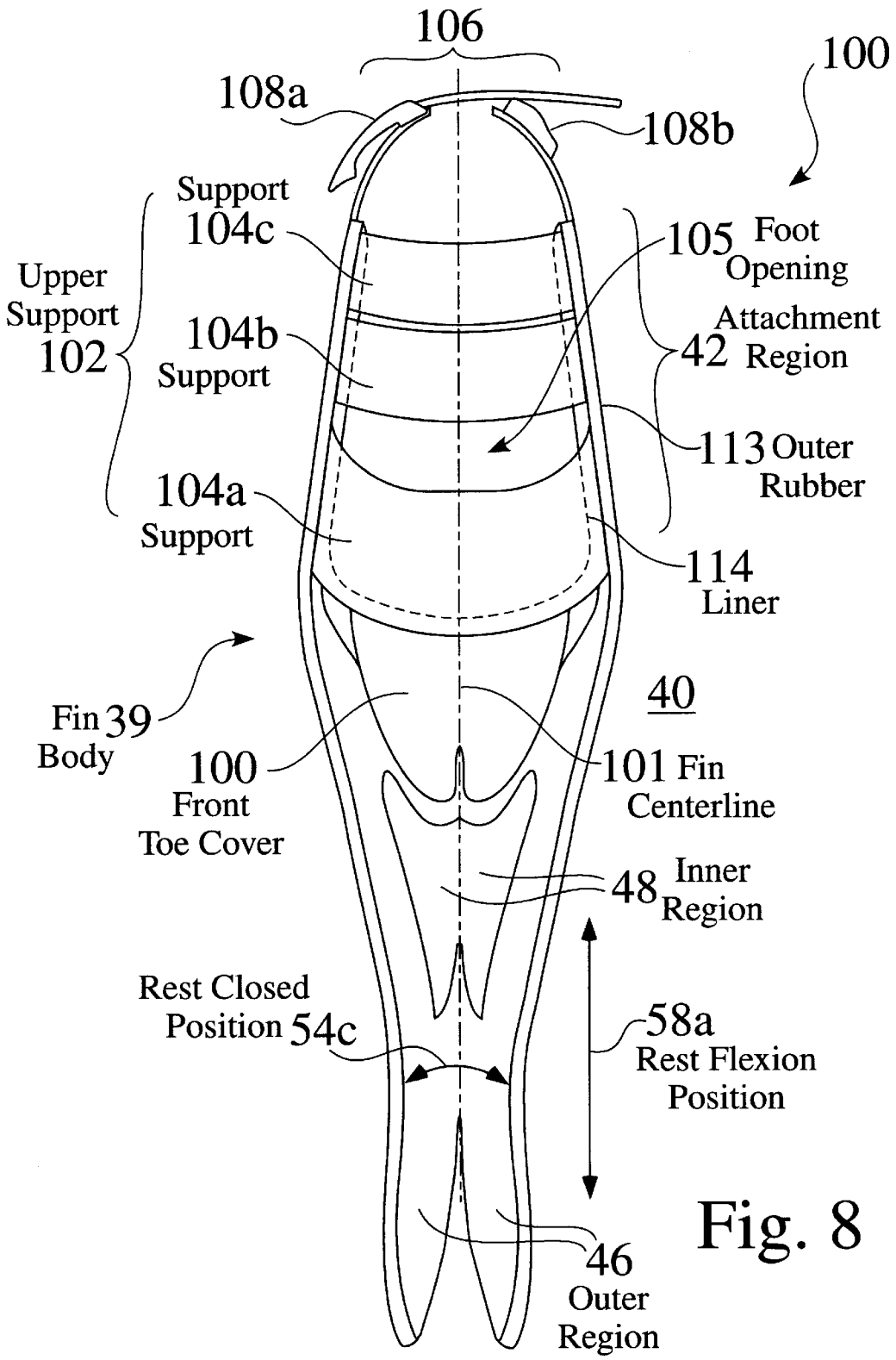
FIG. 8 is a top view of a staged swim fin in a closed position.

The fin blade region 44 of the staged fin 40, e.g. 40*a*, typically comprises one or more inner blade regions 48 and outer blade regions 46, commonly located along a fin centerline 101 (FIG. 8). A central hinge region 50 is also generally located along the centerline 101 of the staged fin 40.

Figure 6:
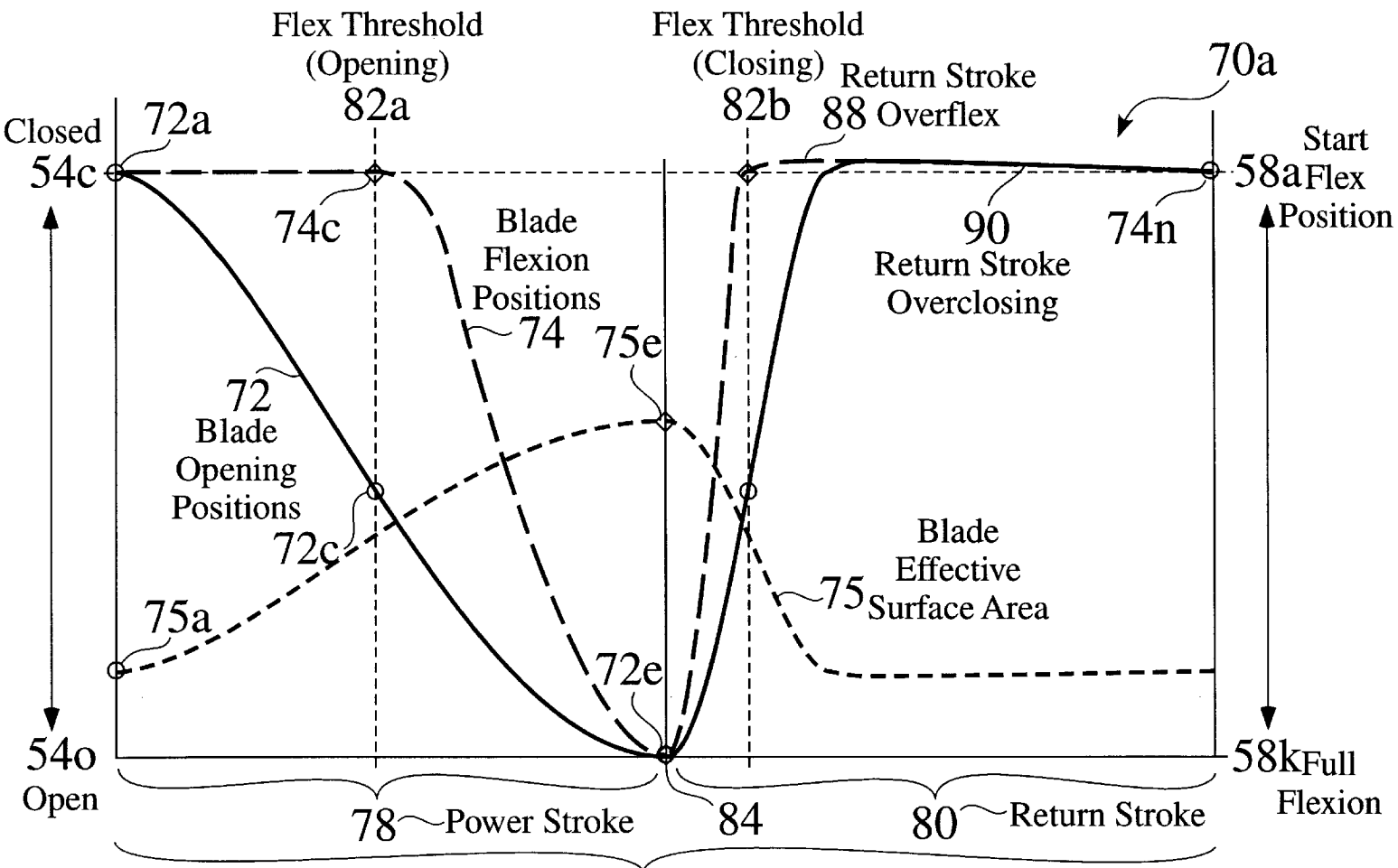
FIG. 6 is a chart showing staged opening and flexion for a staged fin blade during a periodic power and return stroke.
Figure 7:
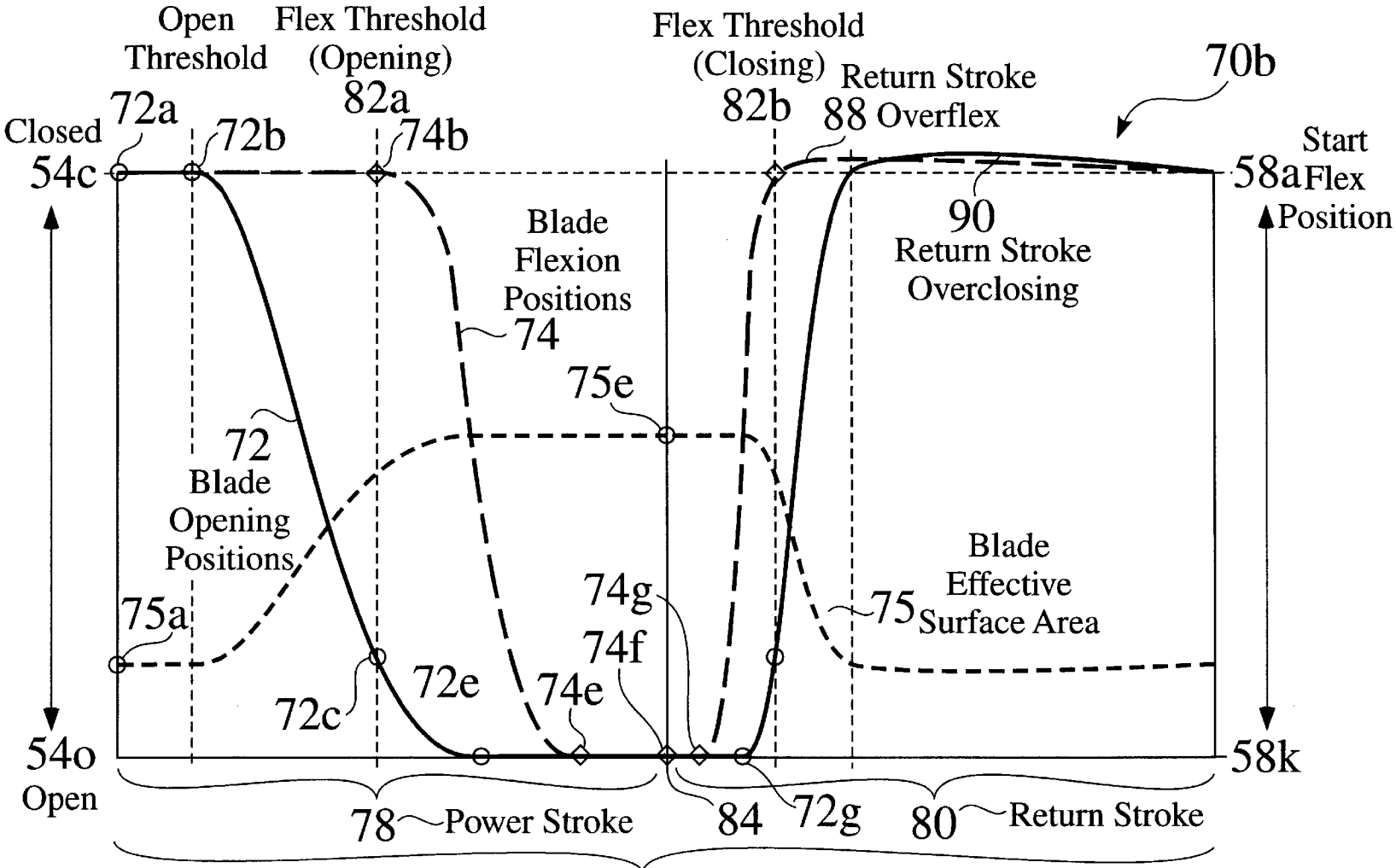
FIG. 7 is a chart showing staged opening and flexion for an alternate staged fin blade during a periodic power and return stroke.

The fin blade region 44 of the expandable swim fin 40*a* is movable between a plurality of opening positions 54, such as between a closed resting position 54*c* to an open position 54*o*, along a defined opening path 52. The fin blade region 44 is generally movable in reaction response to water pressure 26 applied to the inner blade regions 48 and outer blade regions 46, such as to a generally concave power surface 43*a*, during a power stroke 78 (FIG. 6, FIG. 7), or to a generally convex return surface 43*b*, opposite the power surface 43*a*, during a return stroke (FIG. 6, FIG. 7). For example, as water pressure 26 is applied to the concave power face 43*a* of the expandable fin 40 shown in FIG. 4 and FIG. 5, the fin blade region 44 opens between opening positions 54. Similarly, as water pressure 26 is applied to the convex return face 43*a* of the staged fin 40, the fin blade region 44 generally closes between opening positions 54, such as from a fully open blade position 54*o* to a closed blade position 54*c*.

While the applied water pressure 26 is described herein as acting upon opposing faces of a fin blade 44, it is understood that static water pressure acts upon all faces of the fin 44. The applied water pressure 26 which provides propulsive forces for a swimmer S is typically provided by movement of the swimmer S, such as by the movement of the swimmers leg and foot F.

The fin blade region 44 of the expandable swim fin 40*a* is also preferably movable from a resting flexion position 58*a* to a full flexion position 58*k*, shown schematically along a defined flex path 56, generally in reaction response to increased water pressure 26 applied on the inner blade regions 48 and outer blade regions 46, and to the opening movement 52.

The flexion movement 58 of the expandable fin 40 is typically controlled through the opening position 54 of the fin blade 44, through the shape and surface area of the inner blade regions 48 and outer blade regions 46, and by the design and position of the central hinge region 50. For example, when the fin blade region 44 is substantially closed 54*c*, as indicated in FIG. 4 and as seen in detail in FIG. 19, FIG. 20, and FIG. 21, the central hinge region 50 is substantially folded, and is generally resistant to flexion 58*a*. As indicated in FIG. 5, and as seen in detail in FIG. 19, FIG. 20, and FIG. 21, when the fin blade region 44 is substantially open 54*o*, the central hinge region 50 is substantially unfolded, and is generally more flexible, as the blade region 44 is approaches a fully flexed position 58*k*.

In some embodiments of the staged swim fin 40, as seen in FIG. 15, the hinge region 50 typically comprises one or more hinge spine regions 55*a*–55*h*, which provide varying longitudinal flexion 58 along the flex axis 56.

FIG. 6 is a chart 70*a* showing an exemplary staged opening 72, flexion 74, and effective surface area 75 for a expandable staged fin blade 40 during a periodic power stroke 78 and return stroke 80. During a cyclical period 76 for a staged swim fin 40, motion of the staged fin 40 which applies higher water pressure to a power face 43*a* of a staged fin typically results in a general opening of the blade region 44, such as from a resting closed position 54*c* toward a fully open position 54*o*. As well, a general opening of the fin blade 44 results in an increase in the effective surface area 75 of the staged expandable fin 40.

As seen in FIG. 6, as the fin blade 44 opens toward a position 72*c*, the flexibility of the fin 40 approaches a flexion opening threshold 82*a*, whereby the fin blade 44 is allowed to flex 74, from a starting flexion position 58*a* toward a full flexion position. At the end 84 of the power stroke 78 shown in FIG. 6, the fin is fully open 54*o*, and fully flexed 58*k*.

Furthermore, as seen in FIG. 6, as the fin blade 44 closes during a return stroke 80, or upon cessation of application of water pressure 26 against the power face 43*a*, the fin blade 44 flexes back 74, such as.from a fully flexed position 58*k* toward a flexion closing threshold 82*b*, whereby the fin blade 44 returns toward a resting position 58*a*. During the return stroke 80, water pressure 26 is typically applied to the return face 43*b* of the staged fin 40, which can further result in a return stroke overflex 88 and/or overdosing 90.

FIG. 7 is a chart 70*b* showing an alternate exemplary staged opening 72, flexion 74, and effective surface area 75 for a staged fin blade 40 during a periodic power stroke 78 and return stroke 80. Alternate embodiments of the staged swim fin 40 provide a variety of blade surface areas and geometries 46,48, as well as hinge designs 50, to provide varying levels of opening 54 and flexibility 58, such as to provide different levels of propulsion or resistance for a swimmer S. For example, for the staged fin 40 shown FIG. 7, the fin blade 44 is slightly resistant to initial opening during a power stroke 78, until the applied water pressure 26 reaches an opening threshold 72*b*. During the power stroke 78, as the applied water pressure 26 increases against the power face 43*a* beyond the opening threshold 72*b*, the staged fin 40 opens toward a lateral opening position 72*c*, and the flexibility of the fin 40 approaches a flexion opening threshold 82*a*, whereby the fin blade 44 is then allowed to flex 74, from a starting flexion position 58*a* toward a full flexion position 58*k*.

At the end 84 of the power stroke 78 shown in FIG. 7, the expandable fin 40 is fully open 54*o*, and is fully flexed 58*k*. As well, the staged swim fin 40 shown in FIG. 7 reaches a fully open position 54*o* before the end of the power stroke 78, at open position 72*e*, and a fully flexed position 58*k*, at blade flexion 74*e*.

Furthermore, as seen in FIG. 7, as the fin blade 44 closes during a return stroke 80 (or upon cessation or reduction of applied water pressure 26 against the power face 43*a*), the fin blade 44 flexes back 74, such as from a fully flexed position 58*k*toward a flexion closing threshold 82*b*, whereby the fin blade 44 returns to a resting position 58*a*. During the return stroke 80, water pressure 26 is typically applied to the return face 43*b* of the staged fin 40, which can further result in a return stroke overflex 88 and/or overdosing 90. At the end 84 of the power stroke 78 shown in FIG. 7, the fin is fully open 54*o*, and is fully flexed 58*k*.

As seen in FIG. 6 and FIG. 7, various embodiments of the expandable fin 40 provide a wide variety of related opening and flexion profiles 70, e.g. 70*a*,70*b*. For recreational swimmers, snorkelers, scuba divers, and/or free divers, the staged fin 40 provides enhanced water surface and subsurface propulsion during a power stroke 78, while minimizing power and/or energy expenditure for a swimmer S during a return stroke 80. For competitive use, various standardized models of the staged fin 40 provide controlled opening and flexion profiles 70, such as to provide equivalent propulsion enhancement between swimmers S, or to provide non-equivalent propulsion enhancement between swimmers having different abilities, i.e. for handicapping purposes. The expandable fin 40 is also readily used for physical therapy or conditioning, such as to provide increased resistance during either a power stroke 78 or a return stroke 80.

Figure 9:
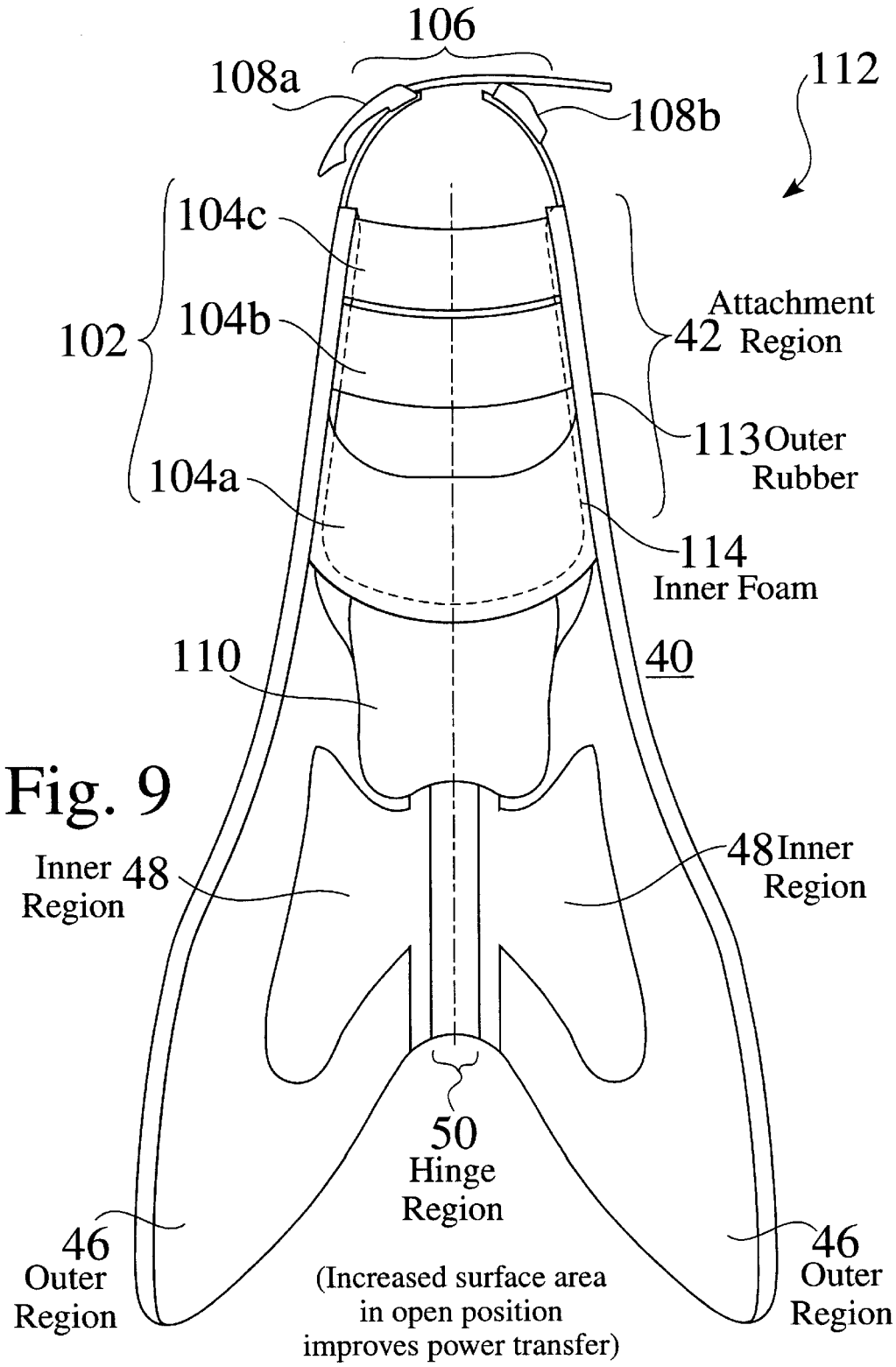
FIG. 9 is a top view of a staged swim fin in an expanded position.

FIG. 8 is a top view 100 of an expandable swim fin 40 in a closed position 54*c*and an unflexed position 58*a*. FIG. 9 is a top view 112 of a staged swim fin 40 in an open position 54*o* and a fully flexed position 58*k*. Expandable fins 40 typically include an attachment region 42, whereby a bare or covered foot F is typically attached to the fin 40. The attachment region 42 of the expandable fin 40 shown in FIG. 8 and FIG. 9 comprises an upper support structure 102, which extends over a foot opening 105. The upper support structure 102 shown in FIG. 8 comprises a plurality of supports 104*a*, 104*b*, 104*c*, which are typically flexible and/or adjustable.

The attachment region 42 of the expandable fin 40 shown in FIG. 8 and FIG. 9 also preferably comprises an outer peripheral structure 113, as well as a compliant inner liner 114. The outer peripheral structure 113 is commonly an integral portion of the fin body 39, which typically comprises a compliant material, such as a rubber or an elastomeric polymer. In some embodiments of the expandable fin 40, the compliant inner liner 114 is preferably comprised of a compliant material, such as an open-cell or closed-cell foam, which readily conforms to the shape of a foot F of a swimmer S. For example, in some embodiments of the expandable fin 40, the compliant inner liner 114 is comprised of neoprene polychloroprene, available through Dupont Dow Elastomers L.L.C., of Wilmington, Del.

The attachment region 42 shown in FIG. 8 and FIG. 9 also preferably comprises a releasable attachment mechanism 106, to affix a foot F within the foot opening 105. The attachment mechanism 106 typically comprises one or more straps 108, such as adjustable ratchet straps 108*a*, 108*b*. The foot opening 105 shown in FIG. 8 and FIG. 9 also comprises a toe cover 110, which generally extends over the front of a foot F. In some embodiments of the expandable fin 40, the toe cover 110 provides an integral structural bias to the opening and closing motion 52, such as to provide increased resistance against opening 78 in reaction to applied water pressure 26, and/or to enhance the closing motion of the staged fin 40 during a return stroke 80.

Figure 10:
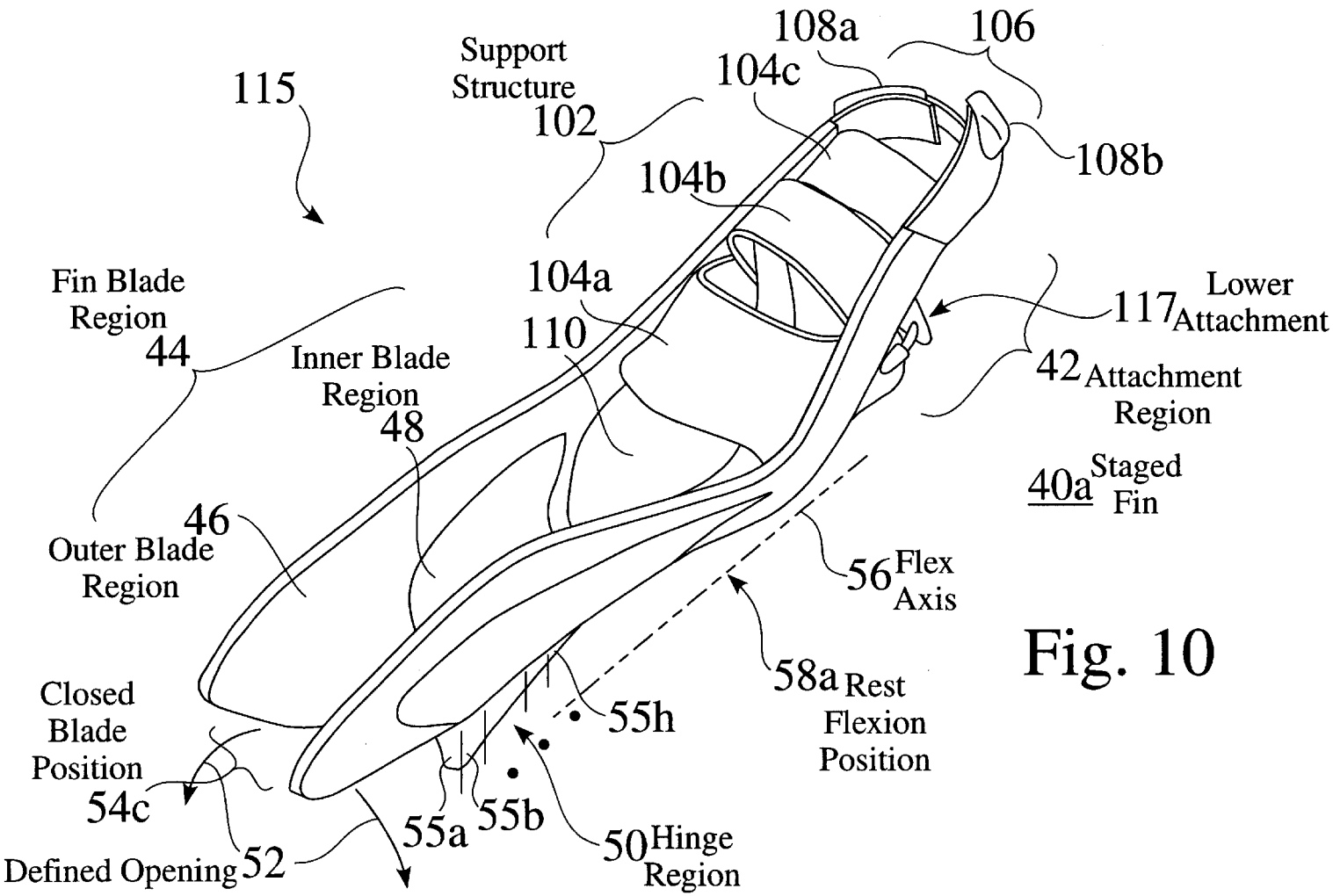
FIG. 10 is a detailed perspective view of a staged fin in a closed position, in which the expandable fin blade closed and unflexed.
Figure 11:
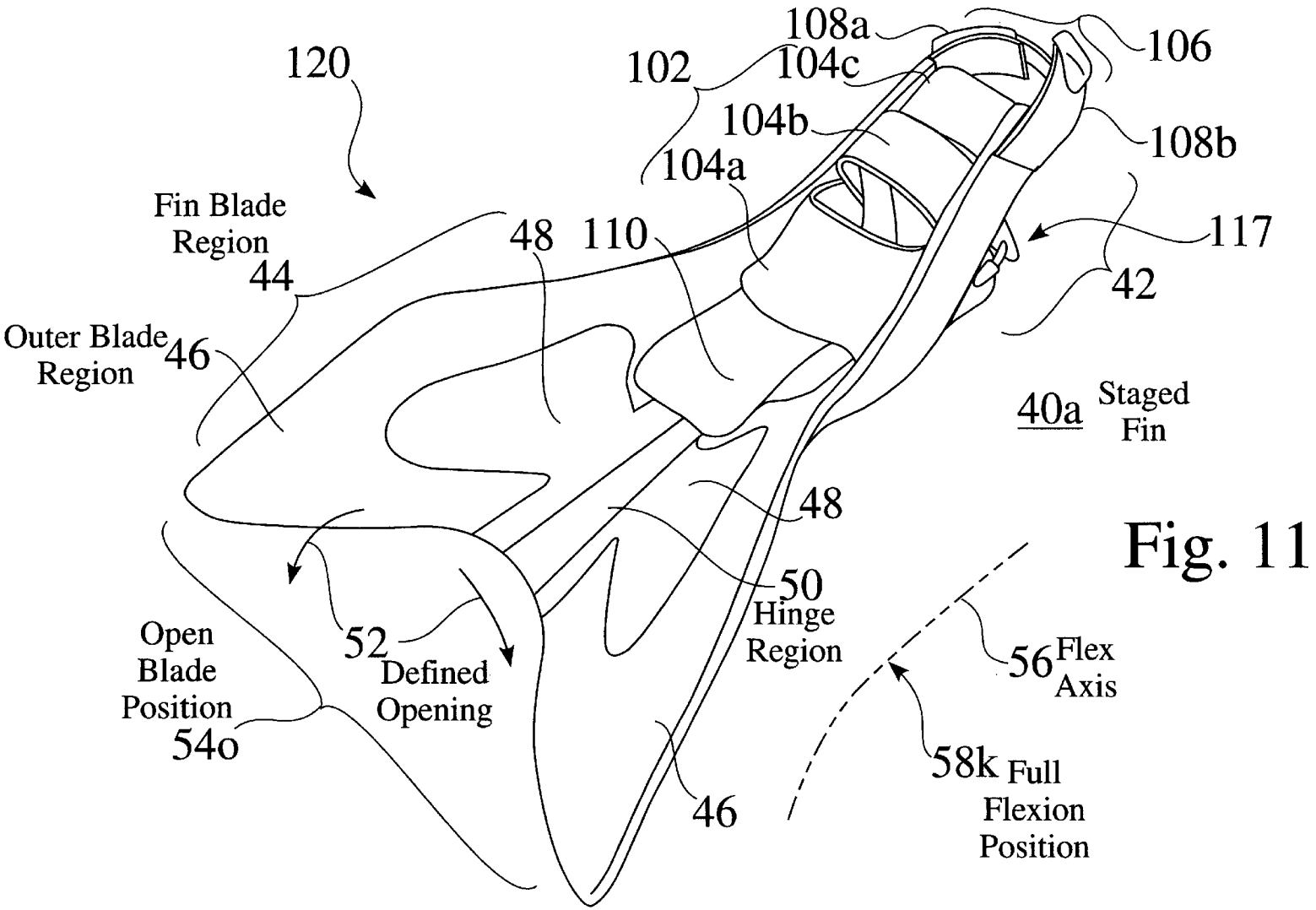
FIG. 11 is a detailed perspective view of a staged fin in an expanded position, in which the expandable fin blade is fully open and fully flexed.

FIG. 10 is a detailed perspective view 115 of an expandable fin 40 in a resting, i.e. static, position 49*a*, in which the expandable fin blade 44 is closed 54*c* and unflexed 58*a*. FIG. 11 is a detailed perspective view 120 of an expandable fin 40 in an expanded position 49*b*, in which the expandable fin blade 44 is fully open 54*o* and fully flexed 58*k*. The attachment region 42 of the expandable fin 40 shown in FIG. 10 and FIG. 11 preferably comprises one or more mechanisms to attach the expandable fin 40 to a foot F, such as an upper attachment mechanism 106, comprising adjustable ratchet straps 108*a*, 108*b*, and/or a lower attachment 117.

Figure 12:
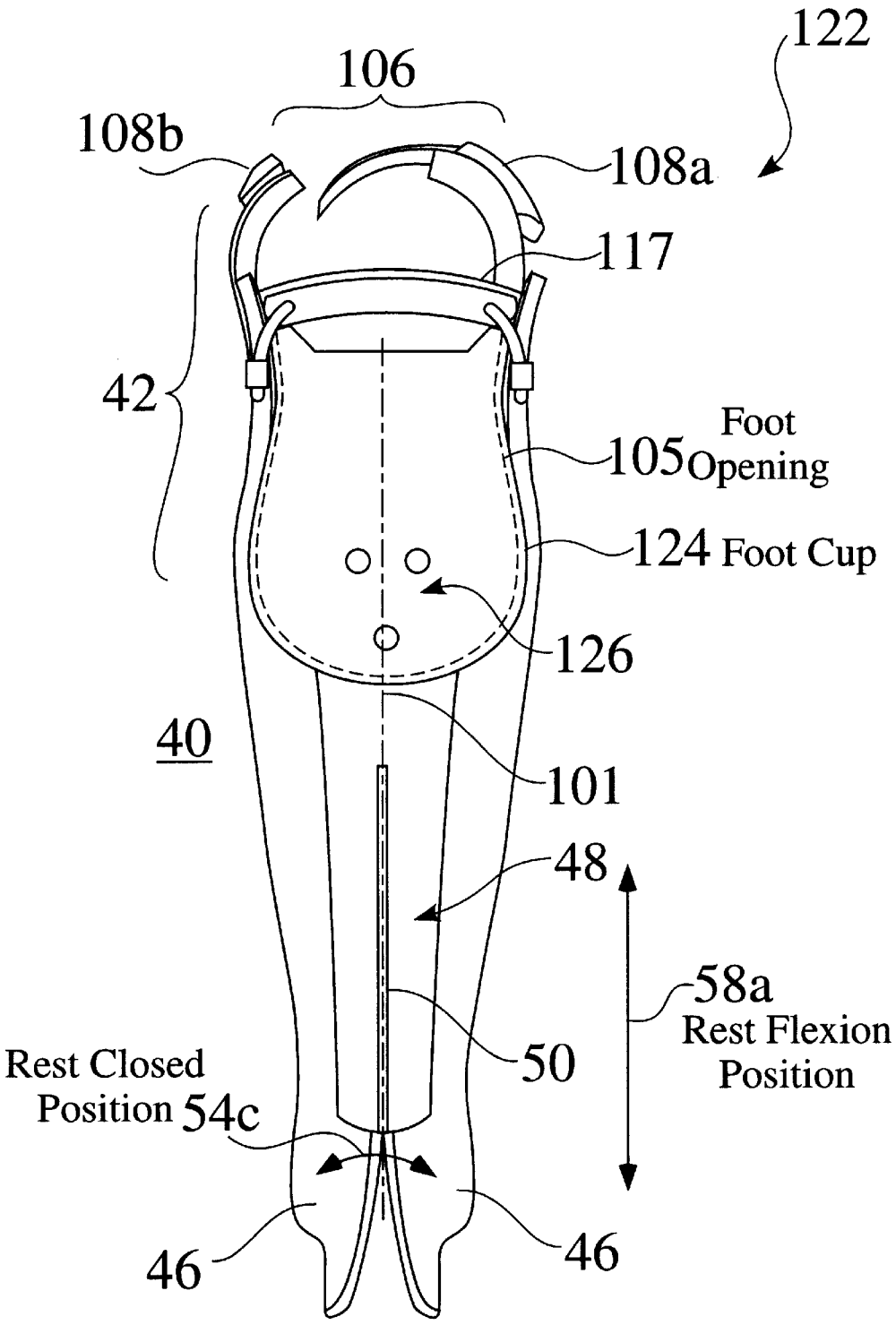
FIG. 12 is a bottom view of a staged swim fin in a closed position.
Figure 13:
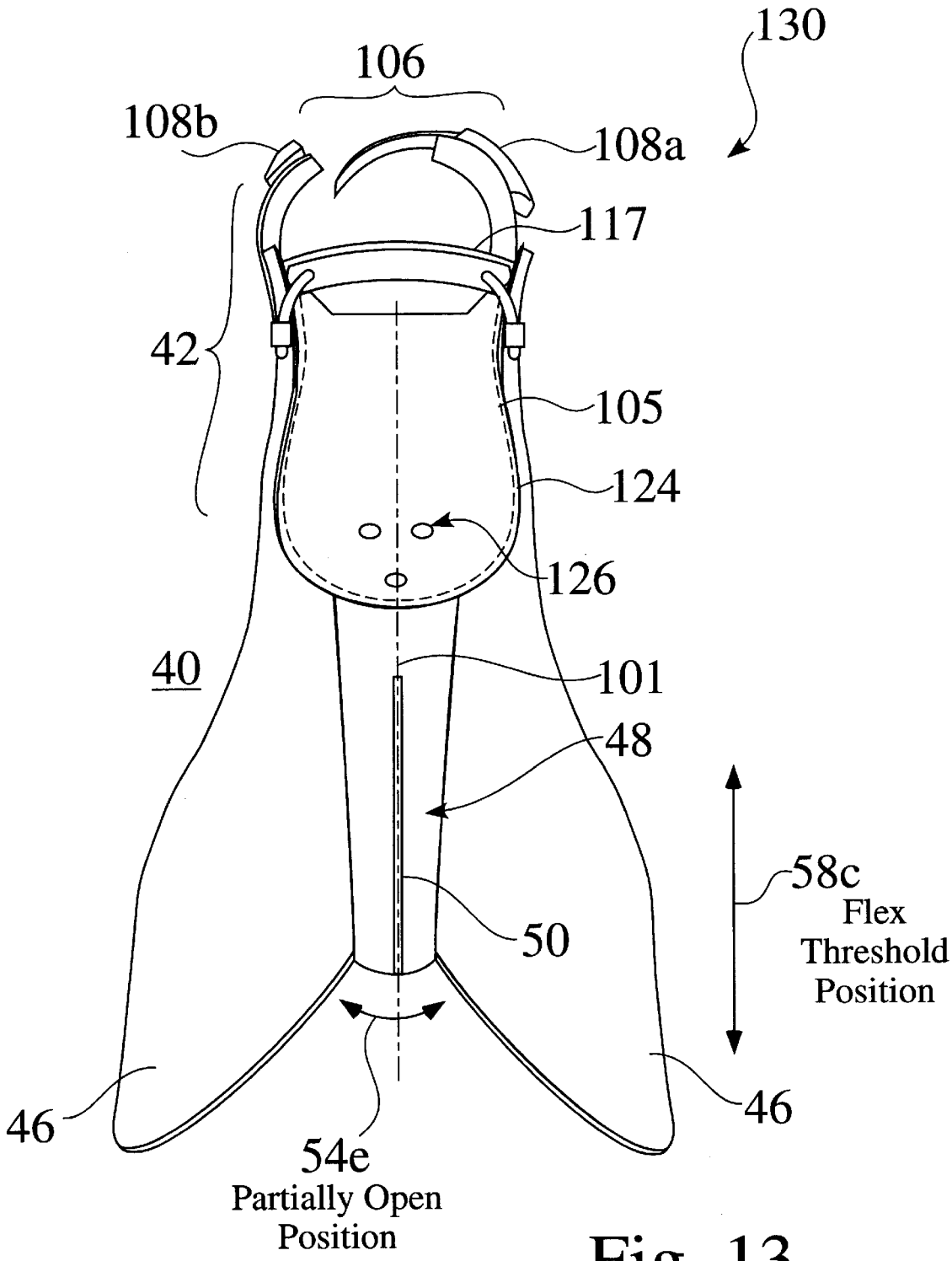
FIG. 13 is a bottom view of a staged swim fin in a partially expanded position.
Figure 14:
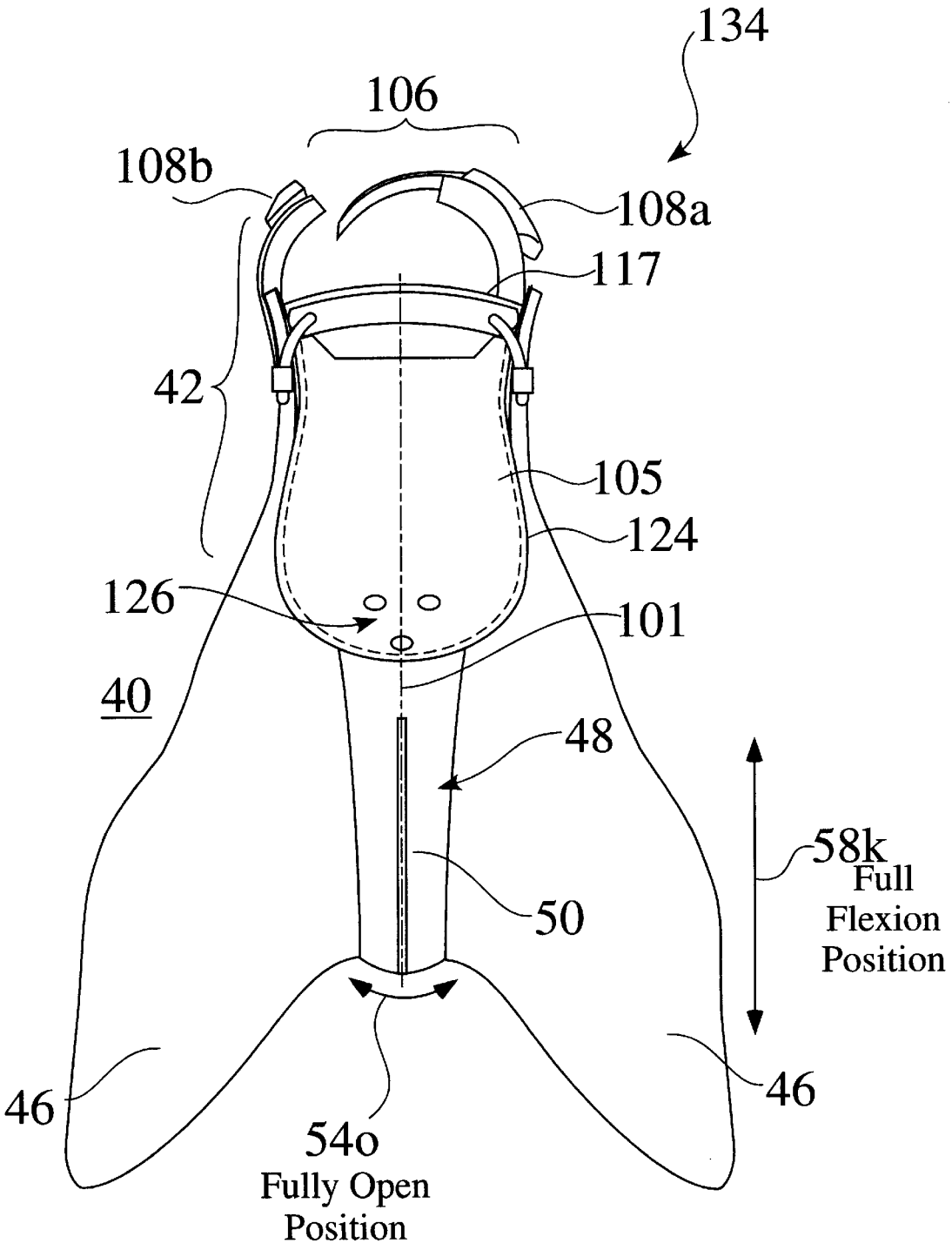
FIG. 14 is a bottom view of a staged swim fin in a fully expanded position.

FIG. 12 is a bottom view 122 of a staged swim fin 40 in a resting, i.e. static, position 49*a*, in which the expandable fin blade 44 is closed 54*c* and unflexed 58*a*. FIG. 13 is a bottom view of a expandable swim fin 40 in a partially expanded position, in which the expandable fin blade 44 is partially open 54, such as at opening 72*c* (FIG. 6), in which the fin blade 44 is unflexed 58*a*, such as at flexion opening threshold 82*a* in FIG. 6. FIG. 14 is a bottom view of an expandable swim fin 40 in a fully expanded position 49*b*, in which the expandable fin blade is fully open 54*o* and fully flexed 58*k*.

The expandable fin 40 shown in FIG. 12 comprises a foot cup structure 124 around the foot opening 105. In some embodiments of the staged fin 40, the foot cup structure 124 is an integral part of the fin body 39, such as a molded foot cup 124. One or more holes 126 may be defined in the foot cup 124, such as to vent or circulate water. In alternate embodiments of the expandable fin 40, the cup structure 124 resembles a shoe, being adapted to receive a bare or covered foot F. In other alternate embodiments of the expandable fin 40, the foot cup structure 124 is attachable to the fin body 39, whereby a foot cup 24 which closely fits a foot F is attachable to a fin body 39 having a desired performance profile. For example, a swimmer with a large foot F can choose a foot cup 124 which closely fits the foot F, and can also select from a variety of fin bodies 39 having desired opening 54 and flexibility 58.

FIG. 15 is a side view 140 of an expandable swim fin 40 in a resting, i.e. static, position, in which the expandable fin blade 44 is closed 54*c* and unflexed 58*a*. FIG. 16 is a side view 150 of an expandable swim fin 40 in a fully expanded position, in which the expandable fin blade is fully open 54*o* and fully flexed 58*k*. As seen in FIG. 15 and FIG. 16, the hinge region 50 of the expandable fin 40 preferably comprises a hinge structure 55, typically comprising a plurality of hinge sections 55*a*–55*h*. The attachment region 42 of the expandable fin 40 shown in FIG. 15 and FIG. 16 preferably comprises one or more mechanisms to attach the expandable fin 40 to a foot F, such as an calf or ankle attachment mechanism 106, comprising adjustable ratchet straps 108*a*, 108*b*, and/or a lower heel attachment 117.

The shape of the hinge sections 55*a*–55*h* is preferably chosen to control a bias for opening the expandable fin 40, such as in reaction response to applied water pressure 26. The shape of the hinge sections 55*a*–55*h* is also preferably chosen to control a bias for flexing the staged fin 40, such as in reaction response to the initial opening 54 and to applied water pressure 26 beyond a flexion opening or closing threshold 82*a*, 82*b*.

The expandable fin 40 may alternately comprise one or more hinges 50 or similar fin sections, either along the fin axis 101 or at other locations on the fin blade 44, such as to aid lateral opening 52, to direct water flow, and/or to provide resistance to flexion 58.

As an expandable fin 40 opens, such as during a power stroke 78, one or more of the hinge sections 55*a*–55*h* typically become more flexible, as a result of the modified cross-sectional profiles of the hinge sections 55. For example, when an expandable fin 40 opens laterally 54 beyond a flexion opening threshold 82*a* during a power stroke 78, the overall longitudinal flexibility of the hinge sections 55*a*–55*h* becomes sufficient to produce longitudinal flexion 58.

The enhanced expandable swim fin 40 therefore provides a blade 44 having both variable expansion and flexion for efficiently propelling a swimmer, such as for performance, for training, or for physical therapy, in which the expandable and flexible blade effectively propels water behind the swimmer S. During a kick, the force generated by the swimmer's leg (one of the largest muscle groups) is transferred to the water through the foot F and toe muscles (a small muscle group). The enhanced expandable swim fin 40 therefore efficiently captures and routes water, pushing the water behind to propel the swimmer S.

Staged Fin Opening. The staged fin 40 opens during a power stroke 78 to provide an increased surface area 75 for the fin blade 44, as seen in movement between a first resting position 49*a* and a second expanded position 49*b*. The first resting fin position 49*a* provides a first effective surface area 75*a* (FIG. 6, FIG. 7) and a first unflexed position 58*a*. The first fin position 49*a* corresponds to a resting position, wherein there are negligible fluid forces 26 acting upon the front power face 43*a* of the fin 40. The second expanded fin position 49*b* provides a second effective surface area 47*b* and a second flexed position 58*k*. The second expanded fin position 49*b* typically corresponds to a power stroke 78, wherein a sufficient fluid force 26 acts upon the front power face 43*a* of the fin 40, to move the fin 40 from the first resting position 49*a* to the second expanded position 49*b*. Similarly, the expandable swim fin 40 returns toward the first resting position 49*a*, as the fluid force 26 acting upon the front power face 43*a* decreases.

In the periodic swim fin motion 76 shown in FIG. 6, during the forward kick 78, the expansion of the staged swim fin 40 preferably corresponds to a plurality of expansion stages 49*a*–49*n*, in which the expansion of the staged swim fin 40 initially comprises an expansion of the surface area 47, such as through lateral opening 54, as seen at stage 72*b*, 72*c*, and in which the latter expansion stages 49 are primarily dominated by flexion 58 of the fin 40.

As the swimmer S kicks downward for example, during a crawl stroke, the water resistance is directed upward towards the surface 43*a* of the flipper blade 44. Upon contacting the blade surface 43*a*, the applied water pressure 26 urges the blade 44 to expand, comprising a lateral opening, in which the effective surface area of the swim flipper is thereby increased. As the blade opens, the blade 44 becomes more flexible, allowing a staged flexion 58 to occur as well.

The enlarged surface area 75 imparts the force of the kick to force away a greater quantity of water. The resulting increased equal and opposite pressure acting upon the foot surface propels the swimmer at a faster rate through the water.

As the swimmer S kicks upward, the water resistance is directed downward towards the return surface 43*b* of the blade 44. Upon contacting the blade surface 43*b*, the water urges the expandable portion of the blade 44 to retract, comprising both a longitudinal unflexing motion 58, as well as a lateral closing motion 54, whereby the effective surface area 75 of the swim flipper 40 is decreased.

As a result of the diminished surface area 75, the blade 44 is subject to decreased water resistance. An upstroke kick is generally weaker than a downstroke kick, for various reasons relating to physiology and the mechanics of the particular crawl stroke. However, with a diminished surface area, the force of the water resistance against the flipper is correspondingly reduced. Thus, the expandable fin 40 is more easily advanced through the water.

Alternate Staged Fin. While the expandable fin 40 is generally described herein with respect to the freestyle crawl stroke, one skilled in the art will readily appreciate that the expandable fin 40 may be applied to other swim strokes, with the appropriate adjustment made for the direction of the kick during the particular stroke. For example, the invention may be used to aid a swimmer performing the backstroke. However, since the directions of the kicks are reversed with respect to the freestyle crawl, the expansion and contraction of the expandable fin 40 is correspondingly reversed.

FIG. 17 is a side view 160 of an alternate staged swim fin 40*b*, in which the outer regions 48 of the fin blade 44 are generally pointed downward in a resting, i.e. unexpanded position, and in which a central hinge region 50 is generally located on the upper surface of the staged fin 40*b*. The alternate staged fin 40*b* shown in FIG. 17 provides an increased effective surface area 75 during a backward kick 162*b* of a swimmer S, and a decreased effective surface area 75 during a forward kick 162*a* of a swimmer S.

The alternate staged fin 40*b* can be used for a wide variety of applications, such as for locomotion, physical exercise, physical therapy, and or rehabilitation. For example, a swimmer S can use the alternate staged fin 40*b* to work out small muscle groups located on the back of the upper and lower legs.

Furthermore, as seen in FIG. 17, the alternate staged swim fin 40*b* comprises an alternate exemplary attachment region 42, in which a fixed portion of a toe cup 124 is located on the upper surface of a foot F, and in which a compliant flexible support structure 102 is located on the lower surface of a foot F. As well, the primary rear attachment 106 shown in FIG. 17 is located generally lower on the swimmer's foot F than the upper secondary attachment.

Figure 18:
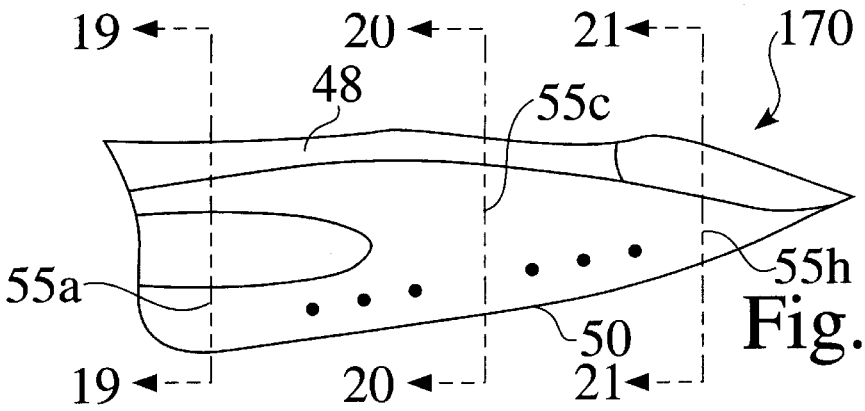
FIG. 18 is a detailed side view of a staged fin central hinge.
Figure 19:
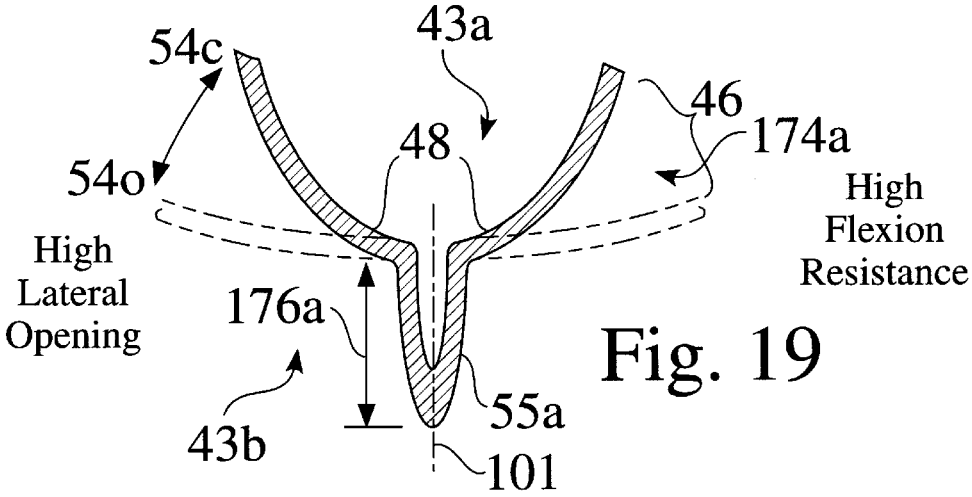
FIG. 19 is a first cross-sectional view of a staged fin central hinge.
Figure 20:
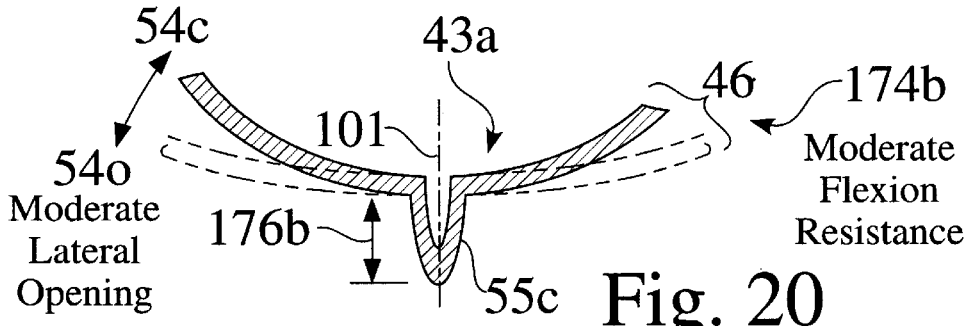
FIG. 20 is a second cross-sectional view of a staged fin central hinge.
Figure 21:
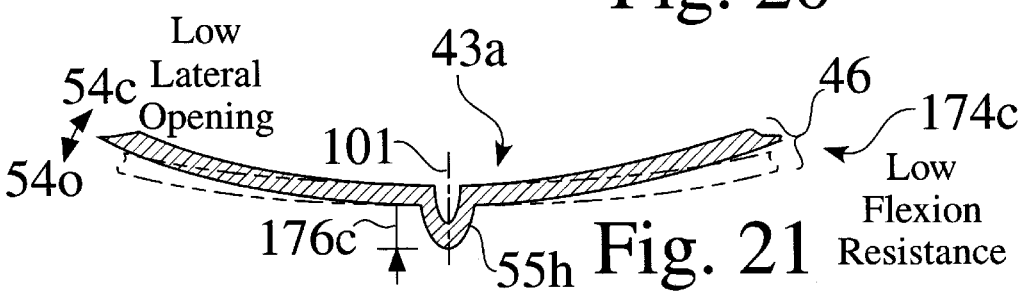
FIG. 21 is a third cross-sectional view of a staged fin central hinge.

Staged Fin Hinge Design. FIG. 18 is a detailed side view of an expandable fin central hinge 50, comprising a plurality of hinge profiles 55*a*–55*h*. FIG. 19 is a first cross-sectional view 174*a* of a fin blade 44 and staged fin central hinge 50, generally corresponding to a hinge profile 55*a*. FIG. 20 is a second cross-sectional view 174*b* of a fin blade 44 and staged fin central hinge 50, generally corresponding to a hinge profile 55*c*. FIG. 21 is a third cross-sectional view 174*c* of a fin blade 44 and staged fin central hinge 50, generally corresponding to a hinge profile 55*h*.

The blade region 44 of the expandable fin 40 is typically comprised of a flexible material, such as a rubber or an elastomeric polymer. In some embodiments of the expandable fin 40, the thickness of the blade region 44 is defined by the desired lateral motion 52 and flexion 58, in response to applied water pressure during a periodic kicking motion 78, 80.

FIG. 19 shows a sectional view 174*a* of a fin blade 44 and staged fin central hinge 50, generally corresponding to a hinge profile 55*a*, at successive fin opening positions 54, between a resting fin opening 54*c* and a fully open position 54*o*. As seen in FIG. 19, the lateral movement of the outer fin blade regions 48 is significant between the resting fin opening 54*c* and a fully open position 54*o*, which aids significantly to the increase in effective surface area 75 of an expandable fin blade during a power stroke 78. Furthermore, as seen in FIG. 19, the hinge profile 55*a* has a defined hinge height 176*a*, which provides high flexion resistance.

FIG. 20 shows a second cross-sectional view 174*b* of a fin blade 44 and staged fin central hinge 50, generally corresponding to a hinge profile 55*c* as seen in FIG. 18, at successive fin opening positions 54, between a resting fin opening 54*c* and a fully open position 54*o*. As seen in FIG. 20, the lateral movement of the outer fin blade regions 48 provides some movement between the resting fin opening 54*c* and a fully open position 54*o*, which provides an increase in effective surface area 75 of an expandable fin blade during a power stroke 78. Furthermore, as seen in FIG.

20, the hinge profile 55*a* has a defined hinge height 176*b*, which provides some flexion resistance.

FIG. 21 shows a third cross-sectional view 174*c* of a fin blade 44 and staged fin central hinge 50, generally corresponding to a hinge profile 55*h*, at successive fin opening positions 54, between a resting fin opening 54*c* and a fully open position 54*o*. As seen in FIG. 21, the lateral movement of the outer fin blade regions 48 is relatively small between the resting fin opening 54*c* and a fully open position 54*o*(as compared to the lateral movement of the outer fin blade regions 48 for the hinge profiles 55*a*, 55*c*). Furthermore, as seen in FIG. 21, the hinge profile 55*h* has a relatively small defined hinge height 176*b*, which provides a small amount of flexion resistance.

Different embodiments of the expandable fin central hinge 50 provide a variety of hinge profiles 55*a*–55*h*, whereby the lateral opening 54 and flexion 58 can be accurately controlled for an expandable fin 40. As well, different embodiments of the expandable fin 40 comprise a variety of outer blade profiles 48, whereby the effective surface area 75 and moment arm for lateral opening 54 are accurately controlled.

Boot Attachment Mechanisms. As described above, The expandable swim fin 40 is attachable to a foot F of a swimmer S, and is commonly used as one of a pair of staged fins 40. As well, a swimmer S may additionally use a water sock or bootie 181 as an intermediate layer between a foot F and the staged swim fin 40, such as for fit, protection, comfort, and/or for thermal insulation.

While a water sock or bootie 181 may simply provide a sock layer between a foot F and the expandable fin 40, preferred embodiments of the bootie 181 and/or attachment region 42 provide secure attachment between a foot F and the expandable fin 40, such as a primary connection, or in addition to other attachments, e.g. 102, 104, 106, 108, 116.

FIG. 22 is a side view 180 of a first embodiment of secure boot attachment 185*a*. A substrate connection 182, preferably comprising a first connectable substrate 184 and a second connectable substrate 186, provides a secure connection between a water sock or bootie 181 and an expandable fin 40. In one embodiment of the substrate connection 182, the first connectable substrate 184 and the second connectable substrate 186 comprise reusable hook and loop connections, such as a VELCRO™ fastener connection 182, available through Velcro USA, Inc., of Manchester, N.H.

FIG. 23 is a side view 190 of a second embodiment of secure boot attachment 185*b*. A mating connection 192, preferably comprising a first connectable surface 194 and a second connectable surface 196, provides an alternate secure connection between a water sock or bootie 181 and an expandable fin 40. In one embodiment of the substrate connection 182, the first connectable surface 194 and the second connectable surface 196 comprise one or more mating grooves, landings, and/or detents.

FIG. 24 is a side view 200 of a third embodiment of secure boot attachment 186*c*. A binding structure 202, preferably comprising a first binding mechanism 204 and a second binding mechanism 206, provides a releasable secure connection between a water sock or bootie 181 and an expandable fin 40. In one embodiment of the binding structure 202, the first binding mechanism 204 and the second binding mechanism 206 comprise one or more releasable portions 208.

The expandable fins 40 shown in FIG. 23 and FIG. 24 further comprise a textured surface 196 on the lower surface of the attachment region 42, to provide stability during above surface or under surface navigation. For example, for a rough-water surf entry or exit of a scuba diver, the outer regions 46 of the expandable blade 44 are not typically exposed to direct contact with a shoreline surface, e.g. such as sand, rocks, marine vegetation, while the textured surface 196 provides controlled traction for the user. Similarly, for non-swimming subsurface movement, such as walking upon rocks, reefs, and sand strata, the textured surface 196 provides a surface for standing or walking, while the outer regions 46 of the expandable blade 44 do not readily contact the strata.

Figure 25:
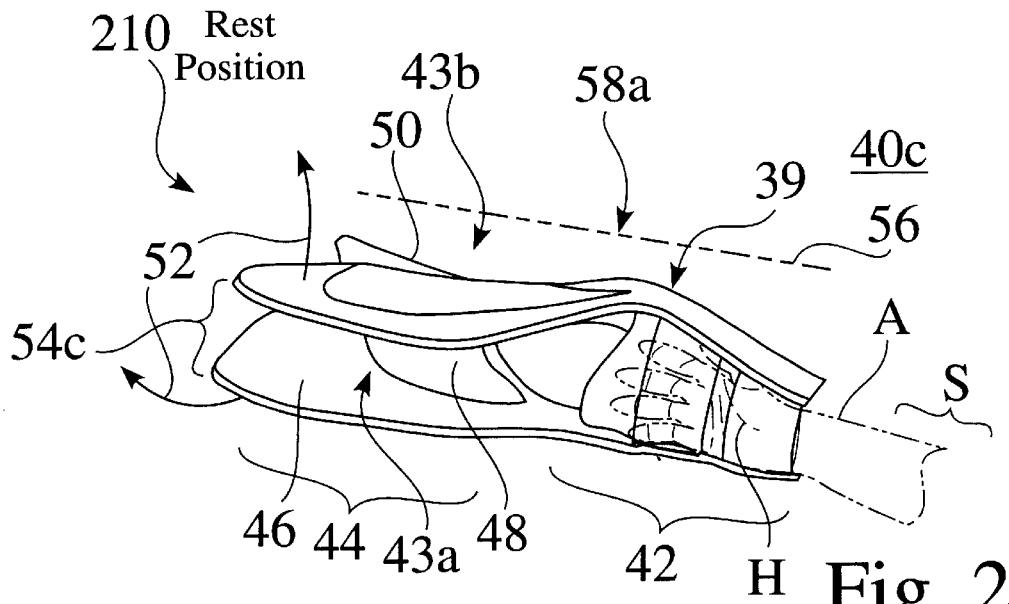
FIG. 25 is a schematic view of a staged hand fin in a closed position.
Figure 26:
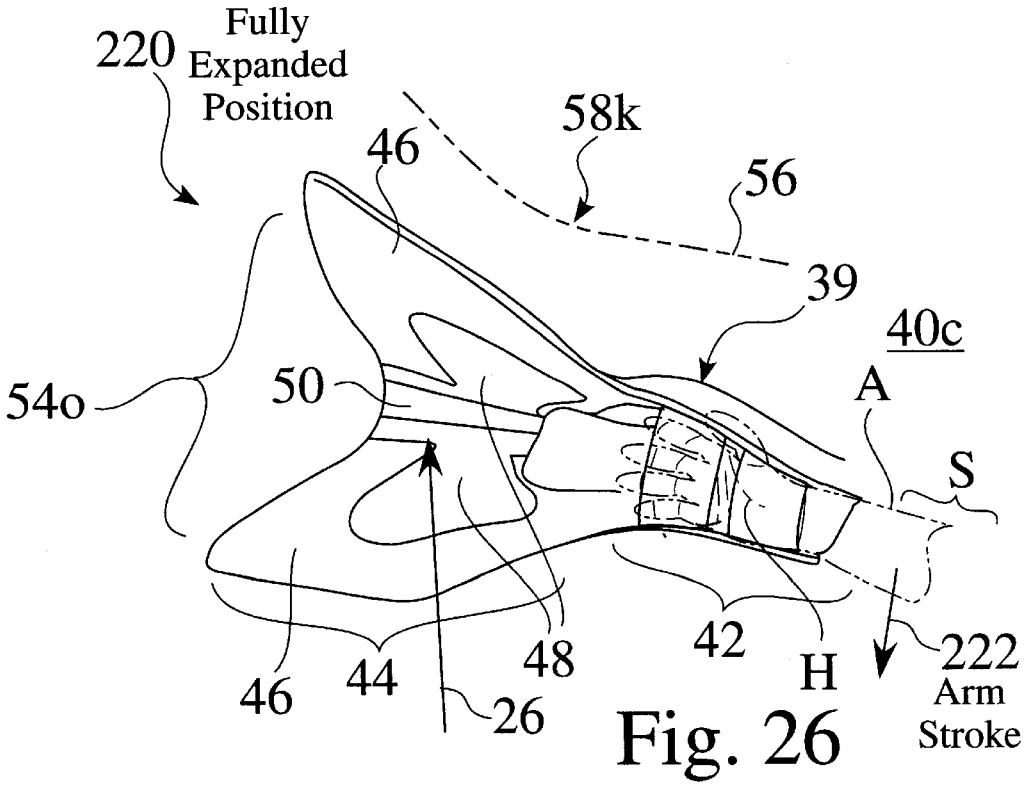
FIG. 26 is a schematic view of a staged hand fin in an expanded position.

Staged Hand Fin. While the staged fin 40 is described above primarily in connection to a foot F, alternate embodiments of the staged fin 40 are adaptable to a hand H of a swimmer S. FIG. 25 is a schematic view 210 of a staged hand fin 40*c* in a resting unexpanded position 54*c*, 58*a*. FIG. 26 is a schematic view 220 of a staged hand fin 40*c* in an expanded position 54*o*, 58*k*.

The attachment region 42 of the staged hand fin 40*c* shown in FIG. 25 and FIG. 26 is connectable to either a bare or gloved hand H, and the concave or power surface 43*a* of the fin blade 44 is preferably generally aligned with the palm of the hand H, such that the arm and hand stroke of the swimmer S is aided by the staged motion of the hand fin 40*c*.

A hand fin 40*c* is typically smaller than a staged foot fin 40*a*, 40*b*, and is relatively more compliant than a staged foot fin 40*a*, 40*b*, such that the hand fin 40*c* is able provides an increased effective surface area 75 and flexion 58 during the arm movement 222 of a swimmer S.

Figure 27:
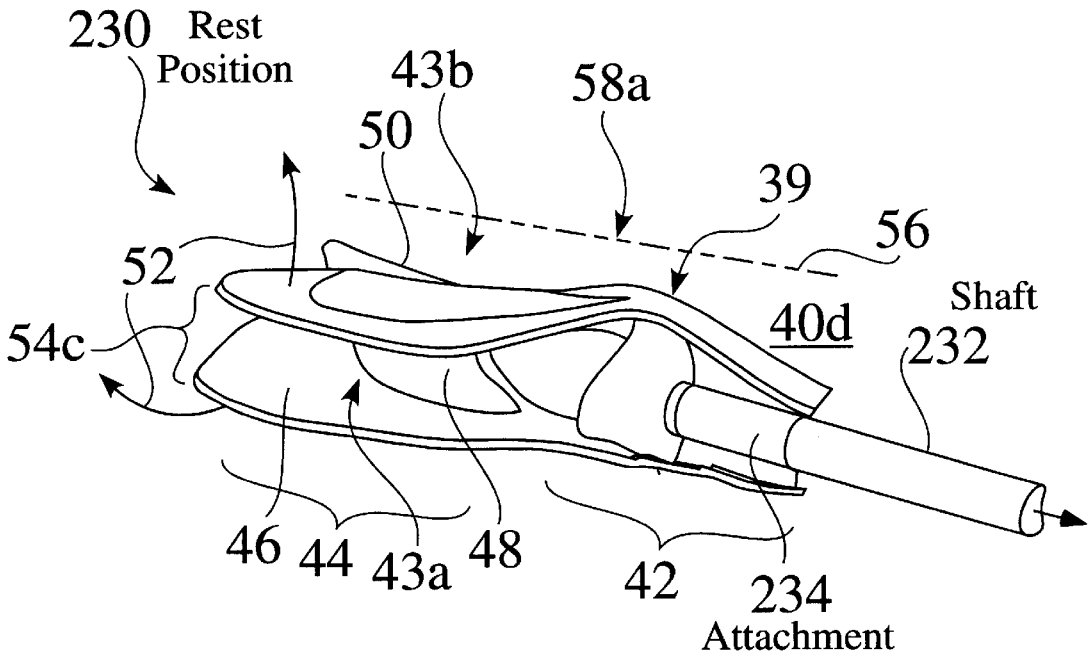
FIG. 27 is a schematic view of a staged fin blade oar in a closed position.
Figure 28:
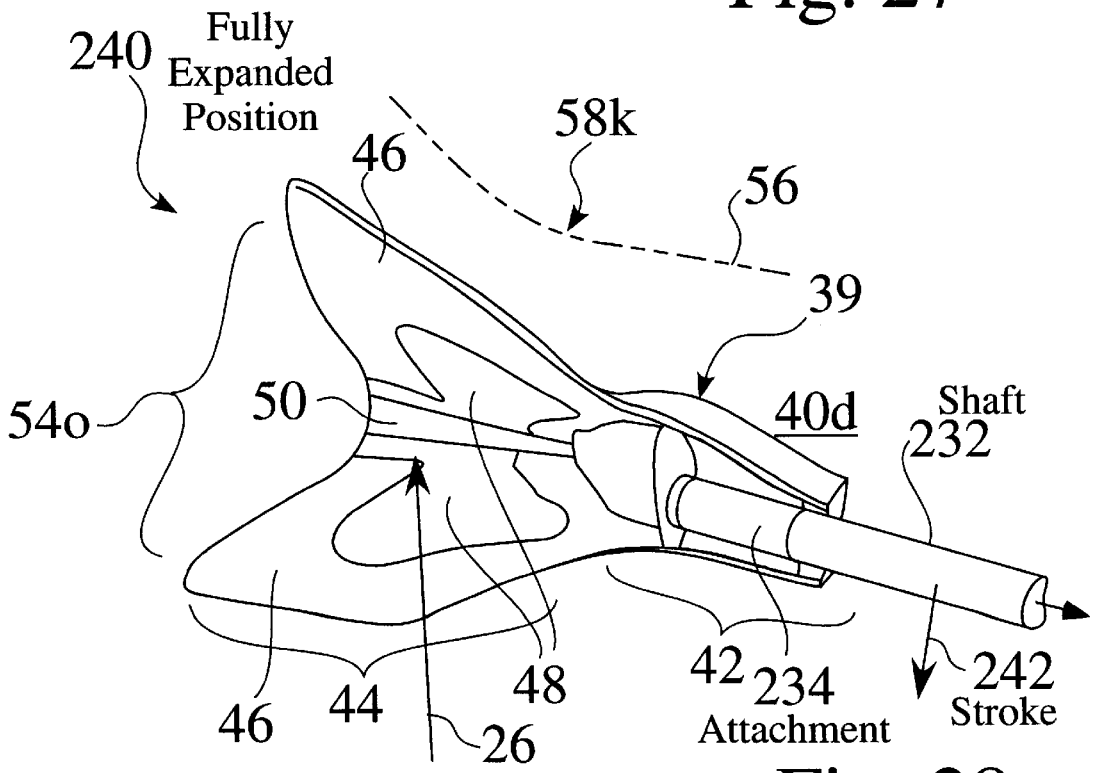
FIG. 28 is a schematic view of a staged fin blade oar in an expanded position.

Staged Oar and Paddle Blades. While the staged fin 40 is described as an aid to a swimmer S, alternate embodiments of the staged fin 40 are also adaptable for other means of propulsion and/or power transfer. For example, FIG. 27 is a schematic view 230 of a staged fin blade oar, 40*d* in a closed position 54*c*, 58*a*. FIG. 28 is a schematic view 240 of a staged fin blade oar 40*d* in an expanded position 54*o*, 58*k*.

The attachment region 42 of the staged fin blade 40*d* is connectable to a paddle or oar shaft 232, and the concave or power surface 43*a* of the fin blade 44 is preferably aligned such that the stroke of the shaft 232 is aided by the staged motion of the expandable fin 40*d*. In one embodiment of the shaft 232, a single staged oar fin 40*d* is mounted to the shaft 232, such as to provide an enhanced single ended paddle or oar, typically for a boat or raft. In an alternate embodiment of the shaft 232, two staged oar fins 40*d* are mounted to the shaft 232, such as to provide an enhanced dual ended paddle or oar, typically for use with a boat, raft, or kayak.

In use, a staged oar or paddle blade 40*d* provides an increased surface area of the blade region 44 during a power stroke 78, and a decreased surface area of the blade region 44 during a return stroke 80, either in or out of water.

Although the invention is described herein with reference to the preferred embodiment, one skilled in the art will readily appreciate that other applications may be substituted for those set forth herein without departing from the spirit and scope of the present invention.

While the Figures show integrally-hinged and flexible blades, the expandable portions of the blades may be formed by any other suitable material or means, such as by discrete hinges and/or elastics. The flippers may be formed of any appropriate materials or combinations of materials that provide flexibility and expandability, while retaining the requisite level of axial support.

The flipper blades 44 may have any number of members, or types of members. For example, a plurality of central members 50 may be provided. One or more of these central members may be radially and/or laterally expandable.

Similarly, two or more lateral members may be provided, and one or more of these lateral members may be laterally expandable. The expandable fin 40 may include channels running along the edges of the blade to facilitate water flow.

As well, various preferred features of the expandable fins 40 may be readily adapted for other structures. For example, the disclosed foot and sock attachment mechanisms and structures are readily suitable for a wide variety of recreation and sports equipment.

Although the expandable fin 40 and its methods of use are described herein in connection with water propulsion, such as for foot flippers, hand flippers, and/or for oars or paddles, the apparatus and techniques can be implemented for a wide variety of propulsion devices and systems, or any combination thereof, as desired.

Accordingly, although the invention has been described in detail with reference to a particular preferred embodiment, persons possessing ordinary skill in the art to which this invention pertains will appreciate that various modifications and enhancements may be made without departing from the spirit and scope of the claims that follow.

What is claimed is:

1. An apparatus, comprising:

a fin body having a front end and a back end; and a blade located at the front end of the body having a first surface and a second surface opposite the first surface, the blade comprising an expandable and flexible portion;

wherein in a first position, the expandable portion of the blade is expanded to increase the effective surface area, in response to water resistance directed to a first surface of the blade;

wherein in a second position, the expandable portion of the blade is contracted to decrease the effective surface area in response to water resistance directed to a second surface of the blade; and wherein the flexibility of the blade changes in response to movement between the first position and the second position.

2. The apparatus of claim 1, wherein the blade is laterally movable between the first position and the second position.

3. The apparatus of claim 1, wherein the back end of the fin body is connectable to a foot.

4. The apparatus of claim 1, wherein the back end of the fin body is connectable to a hand.

5. The apparatus of claim 1, wherein the back end of the fin body is connectable to an oar shaft.

6. The apparatus of claim 1, wherein the fin body comprises a longitudinal axis, and wherein the blade further comprises:

an inner hinge region generally aligned with the longitudinal axis; and one or more outer regions attached and laterally movable about the inner hinge region.

7. The apparatus of claim 1, wherein the first surface of the blade is generally concave.

8. The apparatus of claim 1, wherein the second surface of the blade is generally convex.

9. The apparatus of claim 1, further comprising;

a water sock; and a releasable connection between the back end of the fin body and the water sock.

10. The apparatus of claim 9, wherein the releasable connection comprises at least one connectable substrate between the water sock and the back end of the fin body.

11. The apparatus of claim 9, wherein the releasable connection comprises at least one mating surface feature between the water sock and the back end of the fin body.

12. The apparatus of claim 9, wherein the releasable connection comprises at least one releasable binding mechanism between the water sock and the back end of the fin body.

13. A flipper, comprising:

at least two lateral members and at least one central member joined therebetween to form a blade having a width and a surface area and including at least an expandable portion thereof; and an attachment region joined to the blade;

wherein the expandable portion of the blade is laterally expandable between a plurality of positions to increase the width and the surface area in response to water resistance directed to a first surface of the blade;

wherein the expandable portion of the blade is laterally contractable between the plurality of positions to decrease the width and the surface area in response to water resistance directed to a second surface of the blade; and wherein the flexibility of the blade changes in response between the plurality of positions.

14. The flipper of claim 13, wherein the blade is laterally movable between the first position and the second position.

15. The flipper of claim 13, wherein the attachment region is connectable to a foot.

16. The flipper of claim 13, wherein the attachment region is connectable to a hand.

17. The flipper of claim 13, wherein the attachment region is connectable to an oar shaft.

18. The flipper of claim 13, wherein the attachment region comprises a longitudinal axis, and wherein the blade further comprises:

an inner hinge region generally aligned with the longitudinal axis; and wherein the lateral members are attached and laterally movable about the inner hinge region.

19. The flipper of claim 13, wherein the first surface of the blade is generally concave.

20. The flipper of claim 13, wherein the second surface of the blade is generally convex.

21. The flipper of claim 13, further comprising;

a water sock; and a releasable connection between the attachment region and the water sock.

22. The flipper of claim 21, wherein the releasable connection comprises at least one connectable substrate between the water sock and the attachment region.

23. The flipper of claim 21, wherein the releasable connection comprises at least one mating surface feature between the water sock and the attachment region.

24. The flipper of claim 21, wherein the releasable connection comprises at least one releasable binding mechanism between the water sock and the attachment region.

* * * * *